US010001340B1

(12) United States Patent
Oglesby

(10) Patent No.: US 10,001,340 B1
(45) **Date of Patent: *Jun. 19, 2018**

(54) THERMAL SHIELDING AND VENTING SYSTEM

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/486,212

(22) Filed: Apr. 12, 2017

Related U.S. Application Data

(62) Division of application No. 14/881,368, filed on Oct. 13, 2015, now Pat. No. 9,658,010.

(60) Provisional application No. 62/063,197, filed on Oct. 13, 2014.

(51) Int. Cl.
*F41C 23/16* (2006.01)
*F41C 23/18* (2006.01)

(52) U.S. Cl.
CPC ..... *F41C 23/16* (2013.01); *F41C 23/18* (2013.01)

(58) Field of Classification Search
CPC ..... F41A 13/12; F41A 21/44; F41A 21/24; F41A 21/32; F41A 21/325; F41A 21/34; F41A 13/00; F41C 23/16
See application file for complete search history.

(56) References Cited

U.S. PATENT DOCUMENTS 513,995 A * 2/1894 Garland ..... F41A 13/12 89/14.1
621,085 A * 3/1899 Hookham ..... F41A 21/24 16/DIG. 12
984,750 A * 2/1911 Craven ..... F41A 21/30 181/223
1,004,665 A * 10/1911 Lewis ..... F41A 21/30 181/223
1,296,193 A * 3/1919 Johnston ..... F41A 13/12 89/14.1
1,353,736 A * 9/1920 Farquhar ..... F41A 3/64 40/489
1,379,339 A * 5/1921 Haskell ..... F41A 13/12 89/14.1
1,406,404 A * 2/1922 McCrudden ..... F41A 3/38 89/14.1
1,538,243 A * 5/1925 Gorton ..... F41A 21/34 89/14.2
1,551,617 A * 9/1925 Pohlmann ..... F41A 13/12 89/14.1

(Continued)

*Primary Examiner* — Derrick R Morgan
(74) *Attorney, Agent, or Firm* — Shaddock Law Group, PC

(57) ABSTRACT

A heat shielding and thermal venting system, having a heat shielding element comprising an elongate, tubular member extending from a first end to a second end; a primary portion formed within a cavity of the heat shielding element; a secondary portion formed within the cavity of the heat shielding element, wherein the secondary portion has a reduced inner cross-sectional area when compared to an inner cross-sectional area of the primary portion; a plurality of entry apertures formed through the heat shielding element proximate the first end; a flare portion formed at the second end; and one or more restricted portions formed along the heat shielding element, wherein each restricted portion includes a reduced inner cross-sectional area, when compared to an inner cross-sectional area of an adjacent interior portion of the heat shielding element.

14 Claims, 26 Drawing Sheets

(56) References Cited

U.S. PATENT DOCUMENTS 1,789,835 A * 1/1931 Pedersen ..... F41A 21/24 165/184
2,026,528 A * 1/1936 Green ..... F41A 13/12 89/14.1
2,086,520 A * 7/1937 Baumann ..... F41A 13/12 165/47
2,101,063 A * 12/1937 Green ..... F41A 13/12 89/14.2
2,126,792 A * 8/1938 MacGregor ..... F41A 13/12 89/14.1
2,128,936 A * 9/1938 Green ..... F41A 13/12 89/14.1
2,287,066 A * 6/1942 Rogers ..... F41A 13/12 165/168
2,339,777 A * 1/1944 Green ..... F41A 21/34 89/14.5
2,351,037 A * 6/1944 Green ..... F41A 21/34 89/14.5
2,397,556 A * 4/1946 Magill ..... F01N 1/08 181/239
2,423,109 A * 7/1947 Monnet ..... F41A 13/12 89/14.1
2,467,372 A * 4/1949 De Permentier ..... F41A 13/12 89/14.1
2,805,602 A * 9/1957 Moore ..... F41A 21/26 89/14.5
2,965,994 A * 12/1960 Sullivan ..... F41C 23/16 42/71.01
3,075,314 A * 1/1963 Bakker ..... F41A 13/12 42/71.01
3,090,150 A * 5/1963 Stoner ..... F41A 13/12 42/71.01
3,118,243 A * 1/1964 Manshel ..... F41A 21/02 42/76.02
3,367,054 A * 2/1968 Loffler ..... B29D 23/001 42/71.01
3,399,597 A * 9/1968 Perrine ..... F41A 21/30 181/223
3,776,093 A * 12/1973 Leverance ..... F41A 21/30 89/14.2
4,307,652 A * 12/1981 Witt ..... F41A 21/36 89/14.3
4,346,643 A * 8/1982 Taylor ..... F41A 13/12 165/104.26
4,467,697 A * 8/1984 Witt ..... F41A 5/22 89/191.01
4,479,418 A * 10/1984 Beretta ..... F41A 21/30 89/14.4
4,536,982 A * 8/1985 Bredbury ..... F41C 23/16 42/71.01
4,663,875 A * 5/1987 Tatro ..... F41A 13/12 165/134.1
4,663,876 A * 5/1987 Reaume ..... F41A 13/12 42/69.01
4,762,048 A * 8/1988 Higashi ..... F41A 21/44 165/47
5,010,676 A * 4/1991 Kennedy ..... F41C 23/16 42/71.01
D328,632 S * 8/1992 Bigwood ..... 89/14.3
5,136,924 A * 8/1992 Forster ..... F41A 21/325 89/14.4
5,355,765 A * 10/1994 Rogers ..... F41A 13/12 89/14.4
5,753,846 A * 5/1998 Koon ..... F41A 21/28 42/75.02
5,992,291 A * 11/1999 Widder ..... F41A 21/28 102/520
7,523,580 B1 * 4/2009 Tankersley ..... F41C 23/16 42/71.01
7,707,763 B2 * 5/2010 Brixius ..... F41A 13/06 42/76.01
8,336,243 B2 * 12/2012 Langevin ..... F41C 23/16 42/71.01
D687,508 S * 8/2013 Peterman ..... D22/108
8,857,307 B2 * 10/2014 Tresserras Torre ..... F41A 21/02 89/14.05
8,967,325 B1 * 3/2015 Cronhelm ..... F41A 13/00 181/223
9,103,618 B2 * 8/2015 Daniel ..... F41A 21/325
9,303,949 B1 * 4/2016 Oglesby ..... F41A 3/66
9,658,010 B1 * 5/2017 Oglesby ..... F41A 13/12
2004/0119629 A1 * 6/2004 Hinsverk ..... H01Q 17/00 342/3
2006/0026883 A1 * 2/2006 Hochstrate ..... F41C 23/16 42/75.01
2010/0000396 A1 * 1/2010 Brown ..... F41A 3/72 89/1.4
2010/0269392 A1 * 10/2010 Swan ..... F41C 23/16 42/71.01
2010/0275493 A1 * 11/2010 Polovnev ..... F41A 21/34 42/90
2011/0265365 A1 * 11/2011 Alonso Tricio ..... F41A 21/02 42/78
2012/0152093 A1 * 6/2012 Koumbis ..... F41A 21/30 89/14.4
2012/0174451 A1 * 7/2012 Overstreet ..... F41A 35/06 42/16
2012/0291614 A1 * 11/2012 Koumbis ..... F41A 21/30 89/14.4
2013/0233162 A1 * 9/2013 Schneider ..... F41A 13/12 89/14.3
2013/0276342 A1 * 10/2013 Chvala ..... F41A 13/12 42/90
2014/0076136 A1 * 3/2014 Moss ..... F41A 21/24 89/14.1
2014/0082990 A1 * 3/2014 Lee ..... F41A 21/24 42/96
2015/0101232 A1 * 4/2015 Schoenlau ..... F41G 11/003 42/90
2015/0241166 A1 * 8/2015 Hines ..... F41C 23/22 42/75.02
2015/0316339 A1 * 11/2015 Young ..... F41A 11/02 42/49.01
2016/0010935 A1 * 1/2016 Clarke ..... F41A 21/34 89/14.4
2016/0091276 A1 * 3/2016 Miller ..... F16B 39/04 42/75.02
2016/0123698 A1 * 5/2016 Gellert ..... F41C 23/02 224/150
2016/0169617 A1 * 6/2016 Daley, Jr. ..... F41C 23/16 42/71.01
2016/0209149 A1 * 7/2016 Fischer ..... F41C 33/02
2016/0209162 A1 * 7/2016 Geissele ..... F41C 23/02
2017/0299291 A1 * 10/2017 Spector ..... F41A 3/66

* cited by examiner

THERMAL SHIELDING AND VENTING SYSTEM

ACROSS-REFERENCE TO RELATED APPLICATIONS

This patent application is a divisional of U.S. patent application Ser. No. 14/881,368, filed Oct. 13, 2015, which claims the benefit of U.S. Patent Application Ser. No. 62/063,197, filed Oct. 13, 2014, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present invention relates to a heat shielding and thermal venting systems for firearms.

2. Description of Related Art

It has become commonplace to attach a free floating or other tube or rail systems to the upper receiver of a rifle or other firearm, to be used as a handguard. In most applications, the handguard is attached to the firearm so that it extends from an upper receiver of the firearm and surrounds at least a portion of the firearm barrel.

Typically, such handguard are formed from aluminum or other alloys because of the ease with which the material can be extruded, cut to length, and machined. Furthermore, aluminum offers great strength to weight properties and is robust enough for the most demanding of requirements.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, in order to maintain a relatively compact and manageable outer diameter to the handguard to facilitate better shooting positions, the relative diameters of handguards are typically reduced. In all handguards, and particularly in handguards having a reduced diameter, heat buildup from the proximity of the handguard to the barrel becomes an increasing issue.

The present invention comprises various embodiments of a heat shield tube that provides a ducted thermal extraction system for at least a portion of the firearm. In certain exemplary, nonlimiting embodiments, the heat shield tube is positioned inside a free float or other firearm handguard. The heat shield tube extends over the barrel, gas tube, gas block, and optionally at least a portion of an attached muzzle device and/or suppressor and stops heat from escaping to the handguard and the shooter's hand.

Accordingly, the presently disclosed invention provides a heat shielding and thermal venting system that provides barrel cooling and heat shielding for a firearm.

The presently disclosed invention separately provides a heat shielding and thermal venting system that surrounds at least a portion of the barrel, gas tube, and/or gas block so there is a reduced heat build up to the barrel and/or handguard.

The presently disclosed invention separately provides a heat shielding and thermal venting system that surrounds at least a portion of the barrel, gas tube, and/or gas block so there is a reduced heat signature to the handguard.

The presently disclosed invention separately provides a heat shielding and thermal venting system that may optionally include various inlet openings, holes, or ducts formed in the tube wall, which to allow air ingress at optimum locations.

The presently disclosed invention separately provides a heat shielding and thermal venting system, which does not affect the free float characteristics of the handguard.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures.

While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of the present disclosure will be described in detail, with reference to the following figures, wherein like reference numerals refer to like parts throughout the several views, and wherein.

DETAILED DESCRIPTION OF THE INVENTION

Figure 1:
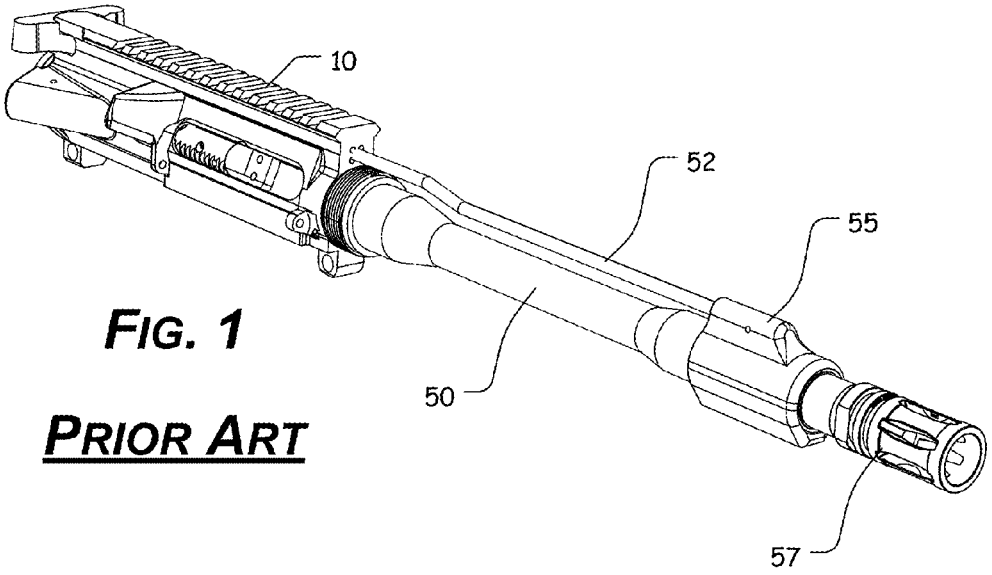
FIG. 1 PRIOR ART
FIG. 1 illustrates a perspective view of certain components of an AR-15 style upper receiver, without a handguard.

For simplicity and clarification, the design factors and operating principles of the heat shielding and thermal venting system and the heat shielding element according to the present disclosure are explained with reference to various exemplary embodiments of a heat shielding and thermal venting system and heat shielding element according to the present disclosure. The basic explanation of the design factors and operating principles of the heat shielding and thermal venting system and/or the heat shielding element is applicable for the understanding, design, and operation of the present invention. It should be appreciated that the present invention can be adapted to many applications where heat shielding and/or thermal venting can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "handguard", "heat shielding", "thermal venting", and "heat shielding element" are used for basic explanation and understanding of the operation of the systems, methods, and apparatuses of the present disclosure. Therefore, the terms "handguard", "heat shielding", "thermal venting", and "heat shielding element" are not to be construed as limiting the systems, methods, and apparatuses of the present disclosure. Thus, for example, the term "heat shielding element" is to be understood to broadly include any elongate, hollow portion of material capable of being attached or coupled to an object.

For simplicity and clarification, the heat shielding and thermal venting system and the heat shielding element of the present disclosure will be described as being used in conjunction with the upper receiver and barrel of a firearm, such as a rifle or carbine. However, it should be appreciated that these are merely exemplary embodiments of the heat shielding and thermal venting system and the heat shielding element and are not to be construed as limiting the present disclosure.

Figure 2:
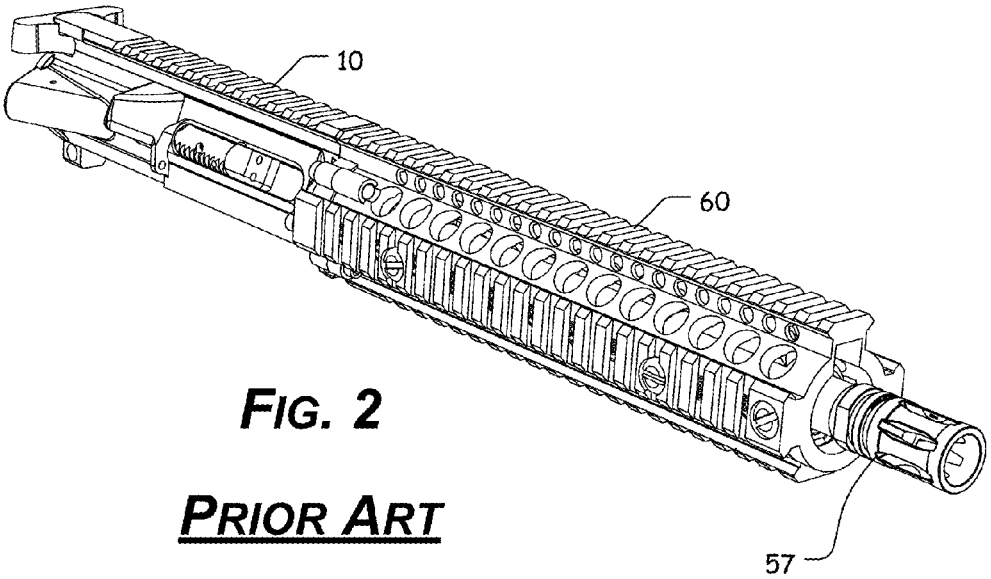
FIG. 2 PRIOR ART
FIG. 2 illustrates a perspective view of certain components of an AR-15 style upper receiver, having an attached, free float handguard.
Figure 3:
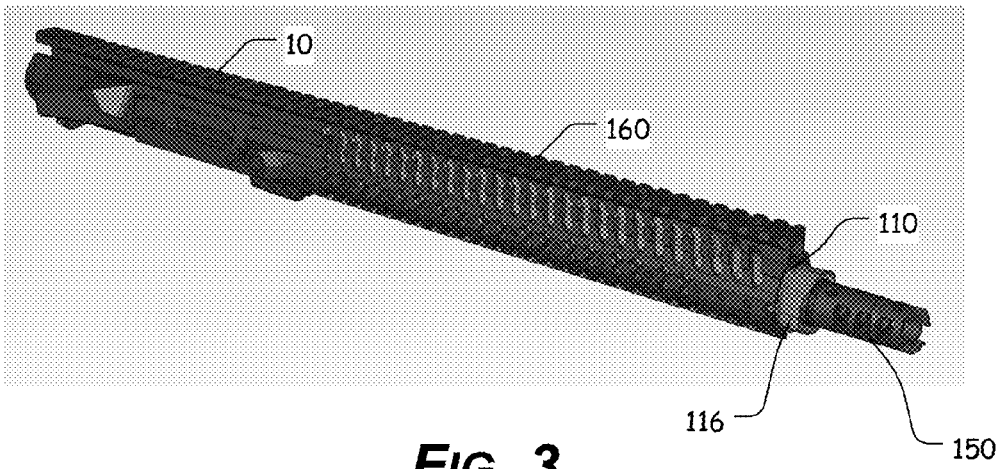
FIG. 3 illustrates a first perspective view of an exemplary embodiment of a heat shielding and thermal venting system, according to the present disclosure.
Figure 4:
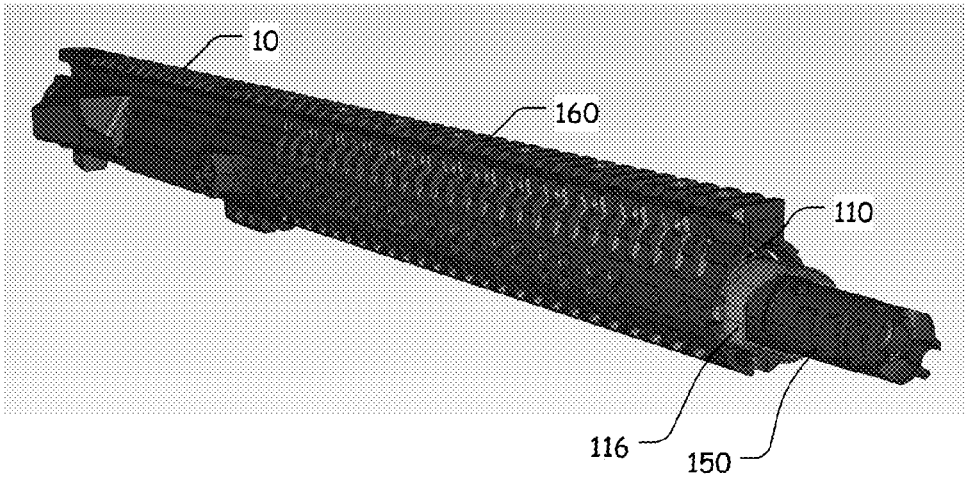
FIG. 4 illustrates a second perspective view of an exemplary embodiment of a heat shielding and thermal venting system, according to the present disclosure.
Figure 5:
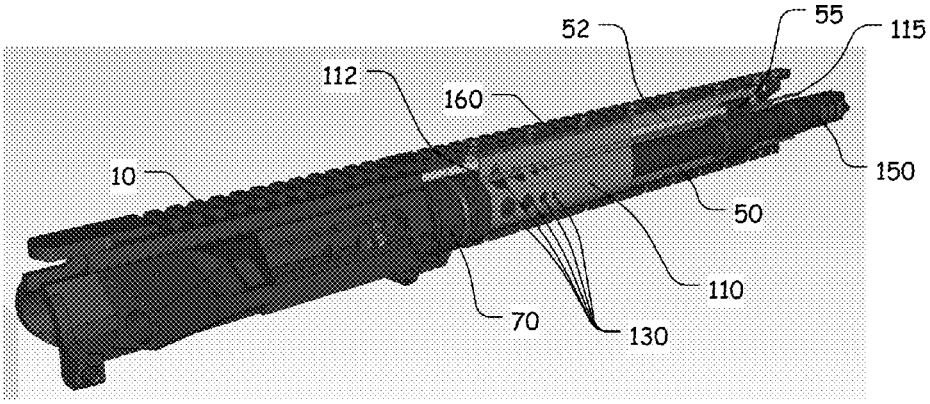
FIG. 5 illustrates a partial cutaway rear perspective view of an exemplary embodiment of a heat shielding and thermal venting system, according to the present disclosure.
Figure 6:
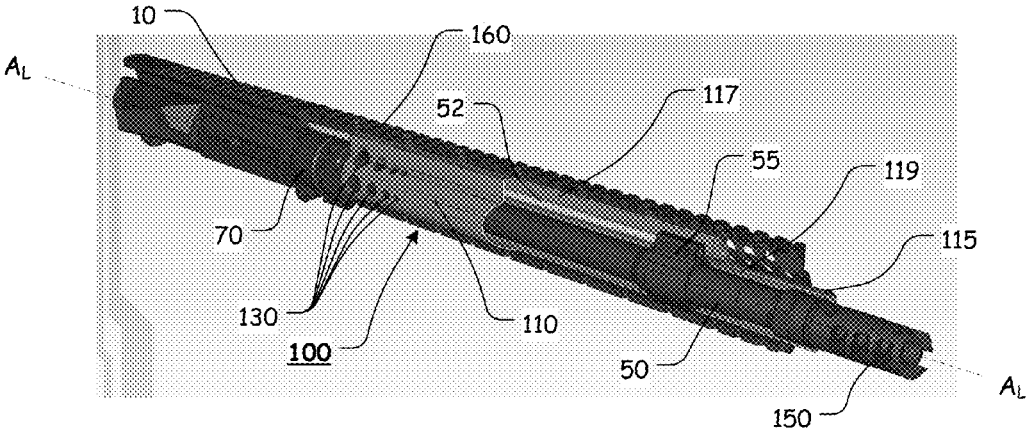
FIG. 6 illustrates a partial cutaway front perspective view of an exemplary embodiment of a heat shielding and thermal venting system, according to the present disclosure.
Figure 7:
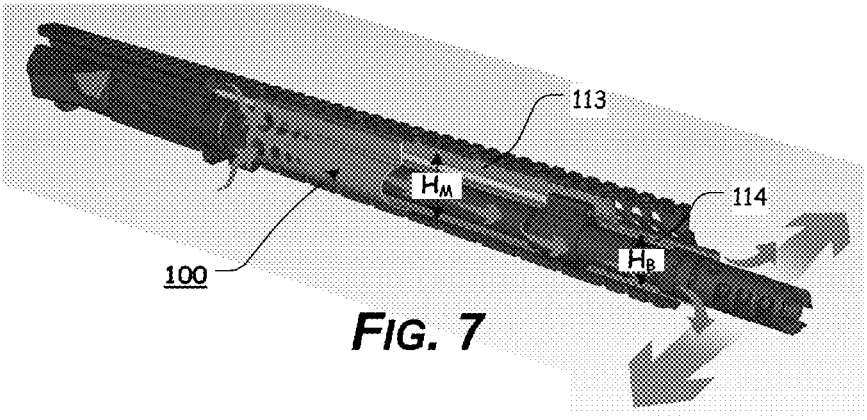
FIG. 7 illustrates a partial cutaway front perspective view of an exemplary embodiment of a heat shielding and thermal venting system, further illustrating exemplary airflow through the heat shield tube according to the present disclosure.

Turning now to the drawing FIGS., FIG. 1 illustrates certain components of an AR-15 style upper receiver, without a handguard, while FIG. 2 illustrates certain components of an AR-15 style upper receiver, having an attached, free float handguard.

Generally, a barrel 50 is aligned with and inserted into the upper receiver 10. A gas tube 52 extends between the upper receiver 10 and a gas block 55. A muzzle device 57, such as a flash hider, flash suppressor, compensator, or muzzle brake is typically secured to the barrel 50.

While not illustrated in FIG. 2, the barrel 50 is typically secured to the upper receiver 10 via interaction of a threaded portion of the upper receiver 10 and an internally threaded barrel nut.

The free float handguard 60 is typically attached to the standard barrel nut, a modified barrel nut, or the threaded portion of the upper receiver 10.

It should also be appreciated that a more detailed explanation of the components of the upper receiver 10, lower receiver 20, barrel 50, barrel nut, gas tube 52, gas block 55, muzzle device 57, and free float handguard 60, instructions regarding how to attach and/or remove the various components and other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the present invention as described.

FIGS. 3-7 illustrate certain elements and/or aspects of an exemplary embodiment of a heat shielding and thermal venting system 100, according to the present disclosure. As illustrated in FIGS. 3-7, the heat shielding and thermal venting system 100 comprises at least some of a duct or heat shielding element 110, comprising an elongate, substantially tubular member extending along a longitudinal axis, $A_L$, from a first end 112 to a muzzle end or second end 115. The heat shielding element 110 is formed so as to be attached or coupled, via interaction with a rail extension/accessory connection system, within at least a portion of the interior of a handguard 160. In various exemplary embodiments, the rail extension/accessory connection system comprises a barrel nut, such as exemplary barrel nut 70.

In certain exemplary embodiments, the heat shielding element 110 extends from the first end 112 and encases the entire barrel 50, gas tube 52, and gas block 55. However, it should be appreciated that the heat shielding element 110 may only extend to encase a portion of the barrel 50, gas tube 52, and/or gas block 55.

As further illustrated in FIGS. 3-7, the heat shielding element 110 includes a primary portion 117 and a secondary portion 119. The primary portion 117 and the secondary portion 119 are in continuous, fluid communication with one another.

The primary portion 117 has a main interior cavity portion 113 having an inner height $H_M$ that is sized so as to allow at least a portion of the barrel 50, gas tube 52, and gas block 55 to be contained within the main interior cavity portion 113 of the primary portion 117. The secondary portion 119 has a barrel interior cavity portion 114 having an inner, vertical height $H_B$ that is sized so as to allow at least a portion of the barrel 50 and/or the muzzle device 150 to be contained within the barrel interior cavity portion 114 of the secondary portion 119.

In various exemplary embodiments, the primary portion 117 and the secondary portion 119 have a combined interior cavity portion and an exterior surface that generally form an offset composite shape of the barrel 50, gas tube 52, gas block 55, and muzzle device 150. In this manner, the main interior cavity portion 113 and the barrel interior cavity portion 114 provide a smooth transition for the flow of fluid through the heat shielding element 110. Additionally, the shape allows the assembled barrel 50 gas tube 52, gas block 50, and muzzle device 150 to be inserted within the composite cavity of the heat shielding element 110.

Thus, in various exemplary embodiments, the secondary portion 119 has a reduced inner cross-sectional area when compared to an inner cross-sectional area of the primary portion 117.

The wall thickness of the heat shielding element 110 can be varied at various points or in various areas to provide increased strength and/or to lighten the heat shielding element 110, as desired.

In various exemplary embodiments, one or more entry apertures 130 are formed proximate the first end 112 of the heat shielding element 110. As illustrated, the entry apertures 130 may comprise a series of varying diameter holes formed through the heat shielding element 110. Alternatively, the entry apertures 130 may comprise one or a series of substantially similar or varying diameter holes formed through the heat shielding element 110. Thus, it should be appreciated that the number, shape, and size of the entry apertures 130 is a design choice based upon the desired appearance and/or functionality of the entry apertures 130.

The entry apertures 130 allow air to flow from outside the heat shielding gas tube 110 into the main interior cavity portion 113 of the heat shielding gas tube 110.

As further illustrated, the heat shielding element 110 is positioned between the handguard 160 and the barrel 50, so as to form a thermal barrier between the handguard 160 and the barrel 50. In various exemplary embodiments, the heat shielding element 110 is positioned so that the barrel 50 does not contact the heat shielding element 110. In this manner, the heat shielding element 110 does not interfere with or affect the free float characteristics of the barrel 50.

The shaping of the flare portion 116 of the second end 115 may be substantially circular or may be flared or widens laterally, perpendicular to the longitudinal axis of the heat shielding element 110, forming a virtual air scoop proximate the second end 115. The flare portion 116 is shaped so as to allow blast gasses escaping from the muzzle device 150 to create a vacuum or air pressure differential behind the blast. The created vacuum draws warm air out of the heat shielding element 110 and draws typically cooler, outside air into the main interior cavity portion 113, through the one or more entry apertures 130, as shown most clearly by the arrows illustrating airflow in FIG. 7.

In various exemplary embodiments, a substantially oval or oblong fitting works in connection with the muzzle device 150, such that blast gasses are directed at approximately 90° relative to the bore axis of the firearm (or longitudinal axis, $A_L$, of the heat shielding element 110), using the Bournelli effect to extract air from the cavity of the heat shielding element 110. The interaction of the muzzle device 150 and the shape of the flare portion 116 act to create an "aircraft wing" like suction, using the Bournelli effect.

Because of the variable diameter and internal shape of the cavity of the heat shielding element 110, a Venturi effect is created within the cavity of the heat shielding element 110, causing air motion to speed up in constricted areas, enhancing the draw, or flow, of air and cooling. Because of the principle of conservation of momentum, the Venturi effect created within the interior cavity of the heat shielding element 110 (as defined by the main interior cavity portion 113 and the barrel interior cavity portion 114) means that as air moves through the interior cavity of the heat shielding element 110, fresh, outside, ambient air is drawn into the cavity of the heat shielding element 110 behind it.

It should be appreciated that these airflow affects may be either passive (i.e., occurring without interaction from firing the weapon) or active (i.e., occurring through the act of firing the weapon and utilizing blast gas in operation).

Interchangeable 'fittings' with different shape designs may be incorporated proximate the second end 115 of the heat shielding element 110, causing different muzzle devices 150 to work in different ways.

Thus, if the firearm is fired, either Venturi or Bernoulli effects cause the faster muzzle gas to draw warm air from around the barrel 50, through the second end 115, where it is mixed with the blast gas and removed. At the same time, typically cooler, ambient air is drawn through the one or more entry apertures 130 and into the interior of the heat shielding element 100.

It should be appreciated that while the entry apertures 130 are primarily shown and described as being circular or oval, and formed proximate the first end 112 of the heat shielding element 110, any number of entry apertures 130 may be formed at any position along the heat shielding element 110 and may take any desired size, shape, or form.

Because of the configuration of the cavity of the heat shielding element 110, airflow can be created within the cavity of the heat shielding element 100 between the one or more entry apertures 130 and the open second end 115. This results in the creation of a 'stack effect' or 'chimney effect' by the temperature and pressure difference between warmer air within the cavity of the heat shielding element 110 and cooler, ambient temperature air outside the heat shielding element 110, as hot air rises and draws in cooler air from outside. When the firearm and handguard/heat shield tube assembly are elevated or lowered a 'stack effect' is induced similar to a chimney or flue system.

Thus, due to the chimney like nature of the design, when the firearm is generally pointed upward or downward, cooler, ambient air from outside the heat shielding element 100 is drawn in at the bottom-most end as the heat rises. This results in an efficient cooling system as the cooler air is drawn into the cavity of the heat shielding element 100 (either through the one or more entry apertures 130 or the second end 115—depending on which end is pointed downward) and directed along the entire length of the barrel 50, the gas tube 52, the gas block 55, and the muzzle device 150, where continuous convective heat transfer results in effective cooling. Here cooler atmospheres air moves into the tube at either its base or mouth (depending on orientation) and a positive buoyancy force is created. Warm air is moved up the tube while cool air enters. This creates a very efficient draft of cooling air across the surface of the barrel within the heatshield tube and decreases cooling time. This flow of air is generated regardless of whether the firearm is pointed upward or downward.

In various exemplary, nonlimiting embodiments, the heat shielding element 110 is formed of a carbon fiber. Rated to at least 2,200 degrees Fahrenheit the unique heat shielding and thermal venting system 100.

In various exemplary embodiments, the heat shielding element 110 is substantially rigid and is formed of a heat resistant composite material including, for example, carbon fiber and SiC, a silicon carbide compound composed of tetrahedra of carbon and silicon atoms with strong bonds in the crystal lattice. SiC is a particular type of Ceramic Matrix Composite (CMC). CMC composites are lightweight, very strong with very low thermal conductivity making them functional for this application. Alternate materials of construction of the various components of the heat shielding element 110 may include one or more of the following: steel, stainless steel, aluminum, titanium, and/or other metals, as well as various alloys and composites thereof, plastic, glass-hardened polymers, polymeric composites, polymer or fiber reinforced metals, carbon fiber or glass fiber composites, carbon fiber resin, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the heat shielding element 110 is a design choice based on the desired appearance and functionality of the heat shielding element 110.

It should be appreciated that certain elements of the heat shielding element 110 may be formed as an integral unit. Alternatively, suitable materials can be used and sections or elements of the heat shielding element 110 may be made independently and attached or coupled together, such as by frictional engagement, adhesives, welding, screws, rivets, pins, or other fasteners, to form the heat shielding element 110.

By providing improved cooling and by surrounding the barrel 50 and related components, there is a significant reduction to the thermal signature of the barrel 50 and the related components, as the heat shielding element 110 retains considerable heat. In various exemplary embodiments, insulation material can be fitted around the heat shielding element 110, either inside or outside the cavity, between the heat shielding element 110 and the handguard 160, to further reduce the thermal signature of the firearm.

Figure 8:
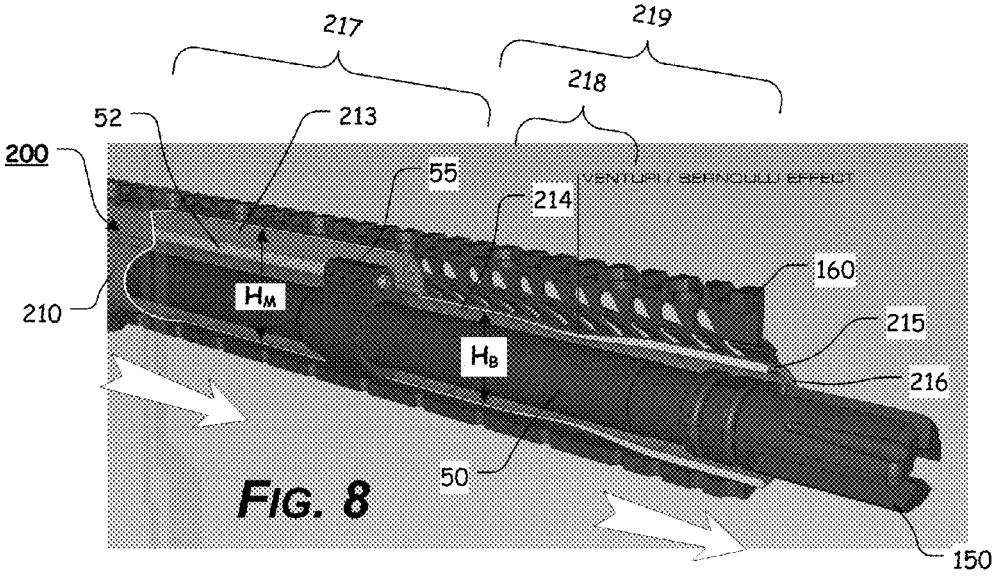
FIG. 8 illustrates a partial cutaway front perspective view of an exemplary embodiment of a heat shielding and thermal venting system, according to the present disclosure.

FIG. 8 illustrates a partial cutaway front perspective view of an exemplary embodiment of a heat shielding and thermal venting system 200, according to the present disclosure. As illustrated in FIG. 8, the heat shielding and thermal venting system 200 comprises at least some of a heat shielding element 210 extending from a first end 212 (not shown) to a muzzle end or second end 215, a main interior cavity portion 213, a barrel interior cavity portion 214, a flare portion 216, a primary portion 217, a secondary portion 219, and one or more entry apertures 230 (not shown).

It should be understood that each of these elements corresponds to and operates similarly to the heat shielding element 110 extending from the first end 112 to the muzzle end or second end 115, the main interior cavity portion 113, the barrel interior cavity portion 114, the flare portion 116, the primary portion 117, the secondary portion 119, and the one or more entry apertures 130, as described above with reference to the heat shielding and thermal venting system 100 of FIGS. 3-7.

However, as illustrated in FIG. 8, as the heat shielding element 210 nears the second end 215 (or the muzzle end of the barrel 50), the heat shielding element 210 is formed into one or a series of shapes that restrict or expand the airflow within a defined portion of the heat shielding element 210. Depending on the shape and position relative to the muzzle device 150, a variety of physical effects like Venturi and Bernoulli can be exploited to extract warm air from the cavity of the heat shielding element 210.

As illustrated in FIG. 8, a Venturi constriction or restricted portion 218 is formed as a 'pinch point' or reduced diameter section within the secondary portion 219. It should be appreciated that one or more restricted portions 218 may be formed in the primary portion 217, the secondary portion 219, and/or a transition area between the primary portion 217 and the secondary portion 219.

Each restricted portion 218 includes a portion or area having a reduced inner cross-sectional area when compared to an inner cross-sectional area of an adjacent interior portion of the heat shielding two 210.

The inclusion of one or more restricted portions 218 provides areas within which the Venturi effect is particularly present. Based on the Venturi effect, as the airflow moves into, through, and out of the restricted portion 218, the velocity of the airflow is increased and the pressure and temperature of the airflow are decreased, when compared to the airflow within the cavity on either side of the restricted portion 218. This further improves the cooling provided by the heat shielding element 210.

Figure 9:
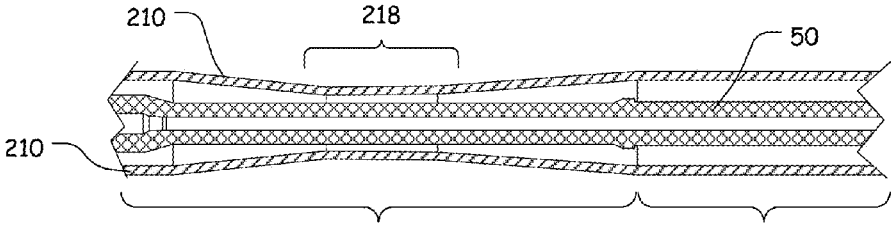
FIG. 9 illustrates a partial, right side cutaway view of an exemplary embodiment of a heat shielding and thermal venting system, further illustrating exemplary airflow through the heat shield tube according to the present disclosure.

As further illustrated in FIG. 9, the Venturi constriction or restricted portion 218 is formed as a 'pinch point' or reduced diameter section within the primary portion 217 of the heat shielding element 110 to induce a Venturi effect within the primary portion 217. In accordance with the principle of continuity, the velocity of a fluid (gas or air) increases as it passes through the restricted portion 218. The reduced diameter section (the restricted portion 218) may have an entry cone at, for example, approximately 20 to 30 degrees (Convergent) and an exit cone at approximately 5 to 15 degrees (Divergent) to reduce drag. This causes airflow to increase in velocity relative to the diameter of the interior cavity of the heat shielding element 210 and assists in airflow throughout the heat shielding element 210 by creating a vacuum on the divergent side.

In various exemplary embodiments, additional holes or apertures (not shown) may be formed in the heat shielding element 210 at or proximate the restricted portion 218 to allow cooler atmospheric air to be drawn into the interior cavity of the heat shielding element 210.

Figure 10:
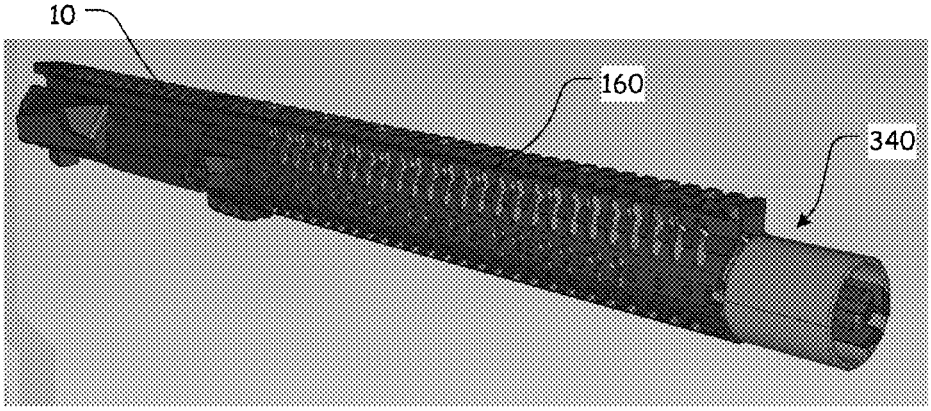
FIG. 10 illustrates a front perspective view of an exemplary embodiment of a heat shielding and thermal venting system, according to the present disclosure.
Figure 11:
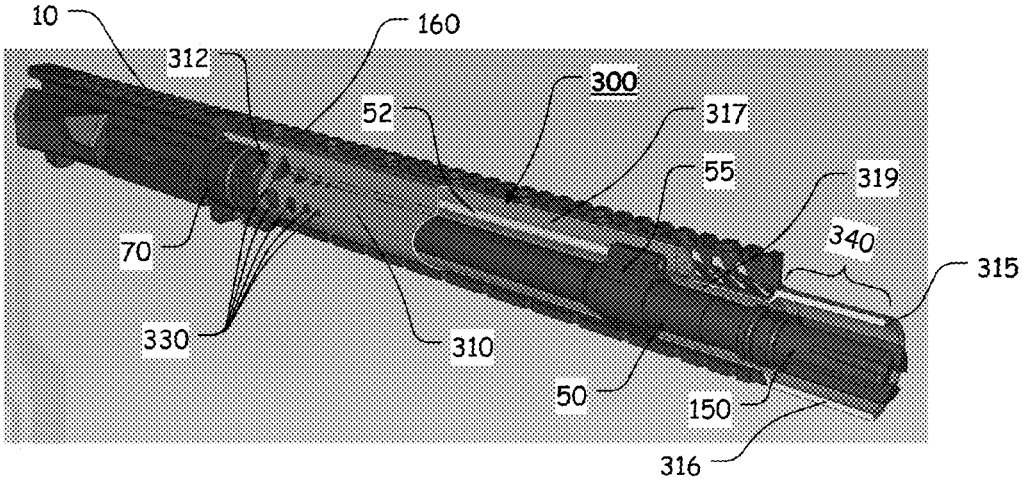
FIG. 11 illustrates a partial cutaway front perspective view of an exemplary embodiment of a heat shielding and thermal venting system, according to the present disclosure.
Figure 12:
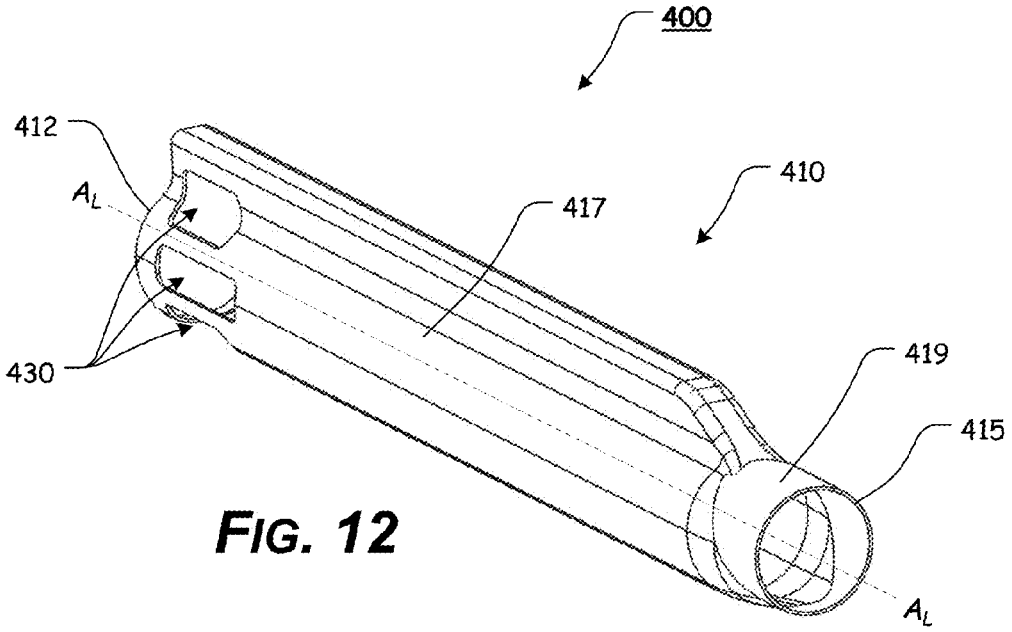
FIG. 12 illustrates a right, front perspective view of an exemplary embodiment of a heat shielding and thermal venting system, according to the present disclosure.
Figure 13:
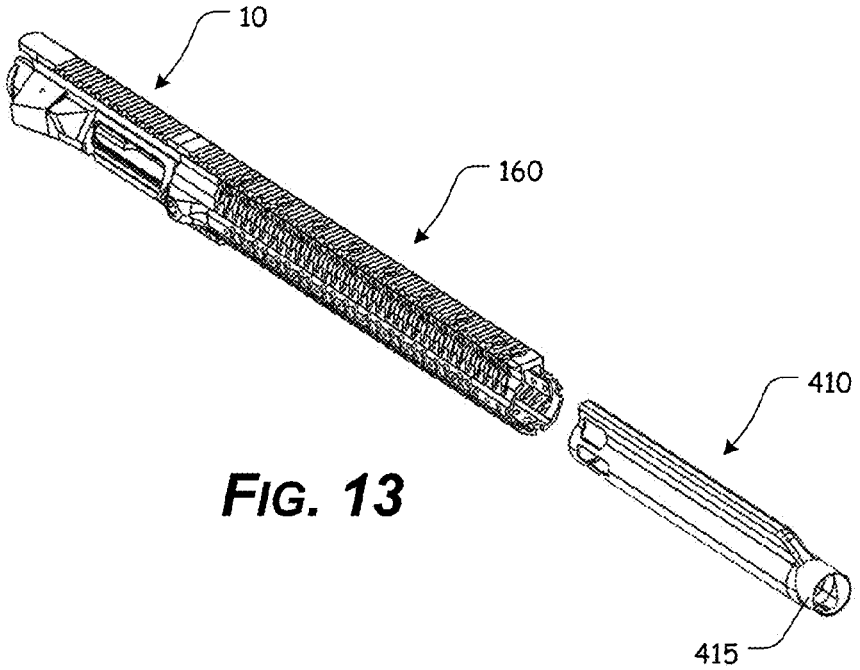
FIG. 13 illustrates a right, front perspective view of an exemplary embodiment of a heat shielding and thermal venting system being aligned with an exemplary handguard, according to the present disclosure.
Figure 14:
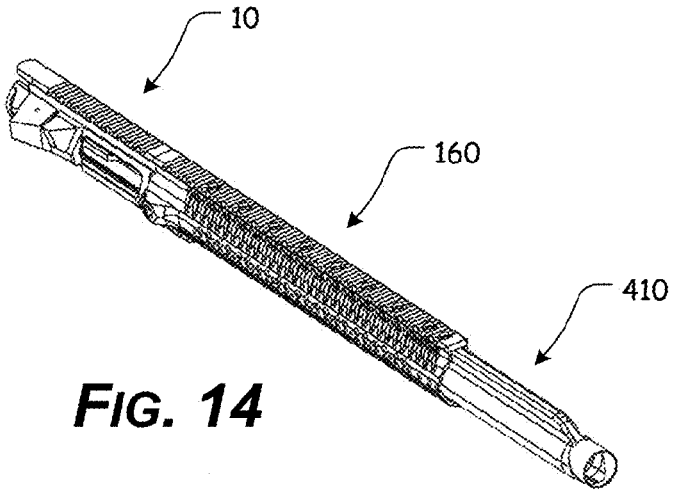
FIG. 14 illustrates a right, front perspective view of an exemplary embodiment of a heat shielding and thermal venting system being further aligned with and partially positioned within an exemplary handguard, according to the present disclosure.
Figure 15:
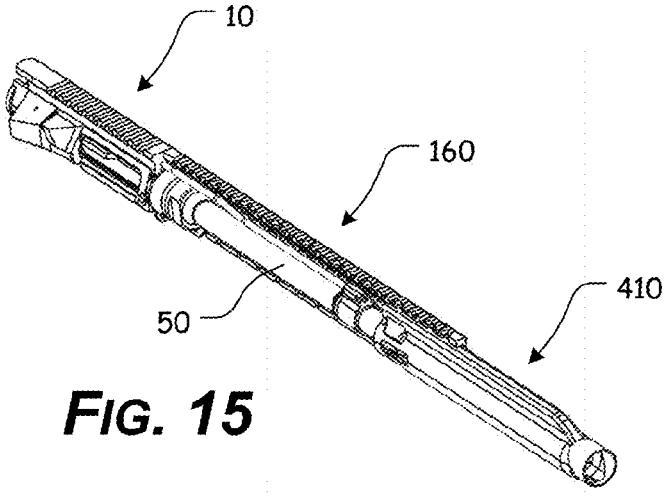
FIG. 15 illustrates a right, front perspective, partial cutaway view of an exemplary embodiment of a heat shielding and thermal venting system being further aligned with and partially positioned within an exemplary handguard, according to the present disclosure.
Figure 16:
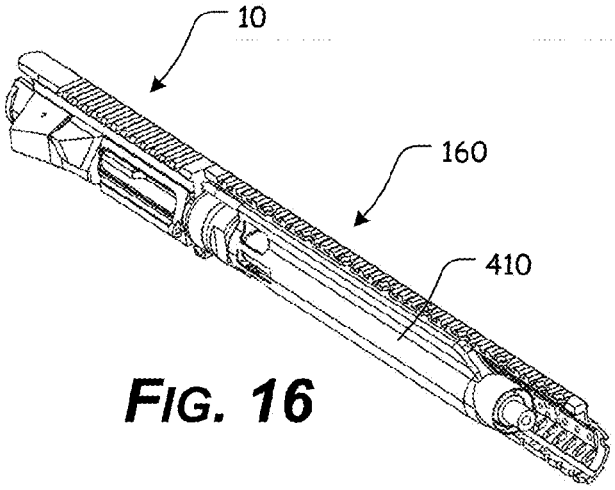
FIG. 16 illustrates a right, front perspective, partial cutaway view of an exemplary embodiment of a heat shielding and thermal venting system aligned with and positioned within an exemplary handguard, according to the present disclosure.
Figure 17:
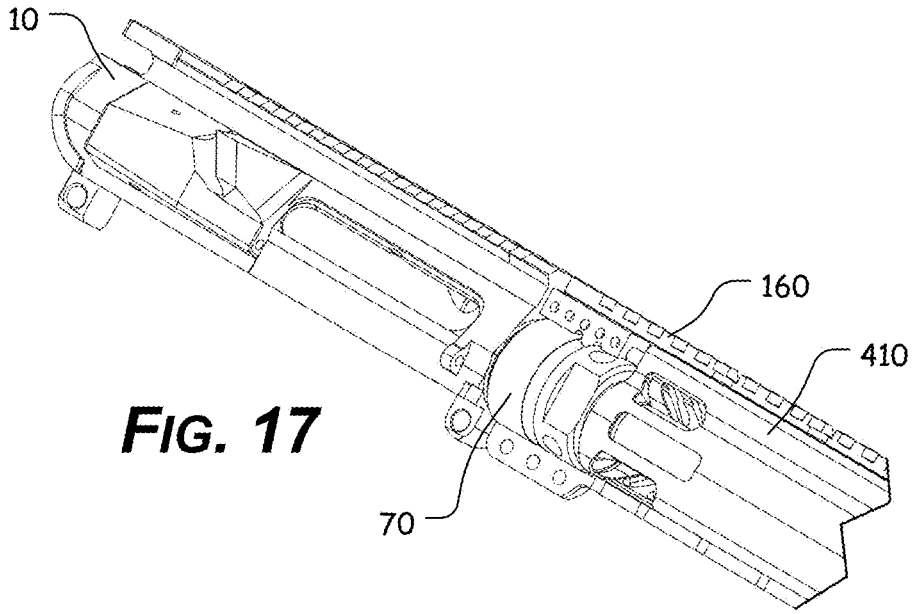
FIG. 17 illustrates a more detailed, right, front perspective, partial cutaway view of an exemplary embodiment of a heat shielding and thermal venting system aligned with and positioned within an exemplary handguard, according to the present disclosure.

FIGS. 10-11 illustrate an exemplary embodiment of a heat shielding and thermal venting system 300, according to the present disclosure. As illustrated in FIGS. 10-11, the heat shielding and thermal venting system 300 comprises at least some of a heat shielding element 310 extending from a first end 312 to a muzzle end or second end 315, a flare portion 316, a primary portion 317, a secondary portion 319, and one or more entry apertures 330. Additionally, the heat shielding element 310 may optionally include one or more restricted portions 318 (not shown).

It should be understood that each of these elements corresponds to and operates similarly to the correspondingly named elements, as described above with reference to the heat shielding and thermal venting systems 100 and 200 of FIGS. 3-9.

However, as illustrated in FIGS. 10-11, the flare portion 316 extends to form an extended flare portion 340 that encloses all or a portion of the muzzle device 150.

FIGS. 12-17 illustrate an exemplary embodiment of a heat shielding and thermal venting system 400, according to the present disclosure. As illustrated in FIGS. 12-17, the heat shielding and thermal venting system 400 comprises at least some of a heat shielding element 410 extending from a first end 412 to a muzzle end or second end 415, a flare portion 416, a primary portion 417, a secondary portion 419, and one or more entry apertures 430. Additionally, the heat shielding element 410 may optionally include one or more restricted portions 418 (not shown).

It should be understood that each of these elements corresponds to and operates similarly to the correspondingly named elements, as described above with reference to the heat shielding and thermal venting systems 100, 200, and/or 300 of FIGS. 3-11.

However, as illustrated in FIGS. 12-17, the entry apertures 430 optionally comprise a plurality of substantially rectangular apertures formed through the heat shielding element 410 proximate the first end 412. Additionally, a substantially smooth transition is provided between the primary portion 417 and the secondary portion 419, providing for enclosure of the firearms gas block and gas tube.

It should be appreciated that the heat shielding element 410 (as with the heat shielding elements 110, 210, and/or 310), may be provided in any desired length or overall external or internal profile.

As further illustrated in FIGS. 12-17, during installation, the heat shielding element 410 is initially aligned with and then inserted within the interior cavity of the handguard 160. Once appropriately positioned within the handguard 160, the heat shielding element 410 may be attached or coupled within the handguard 160 by various methods, such as by mere frictional engagement, adhesives, screws, pins, or other fasteners, to maintain the heat shielding element 410 in a desired position relative to the handguard 160.

In various exemplary embodiments, when the heat shielding element 410 is appropriately positioned within the handguard 160, the heat shielding element 410 is configured within the handguard 160 so that the one or more entry apertures 430 are at least partially aligned with one or more holes or apertures in the handguard 160.

Figure 18:
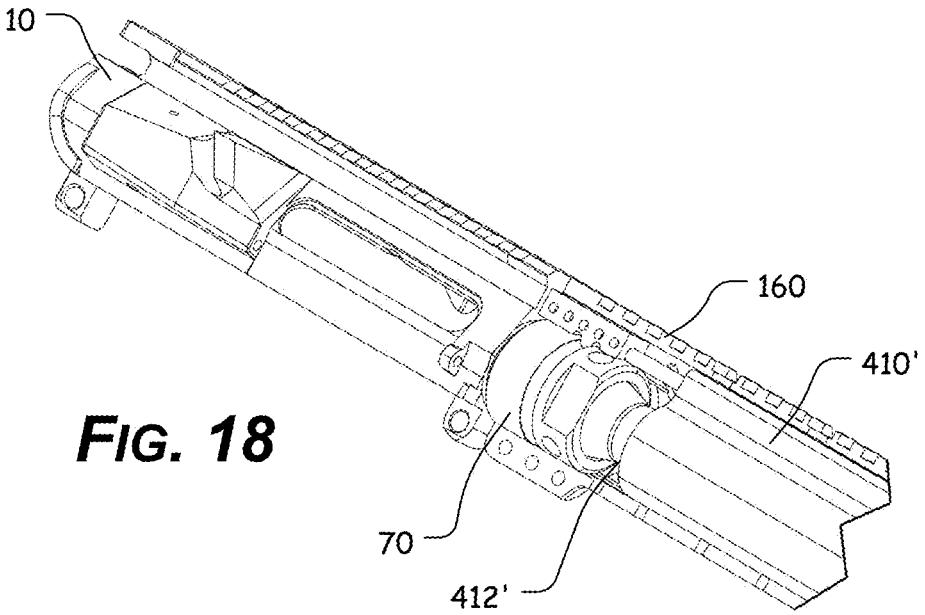
FIG. 18 illustrates a more detailed, right, front perspective, partial cutaway view of an alternate exemplary embodiment of a heat shielding and thermal venting system aligned with and positioned within an exemplary handguard, according to the present disclosure.
Figure 19:
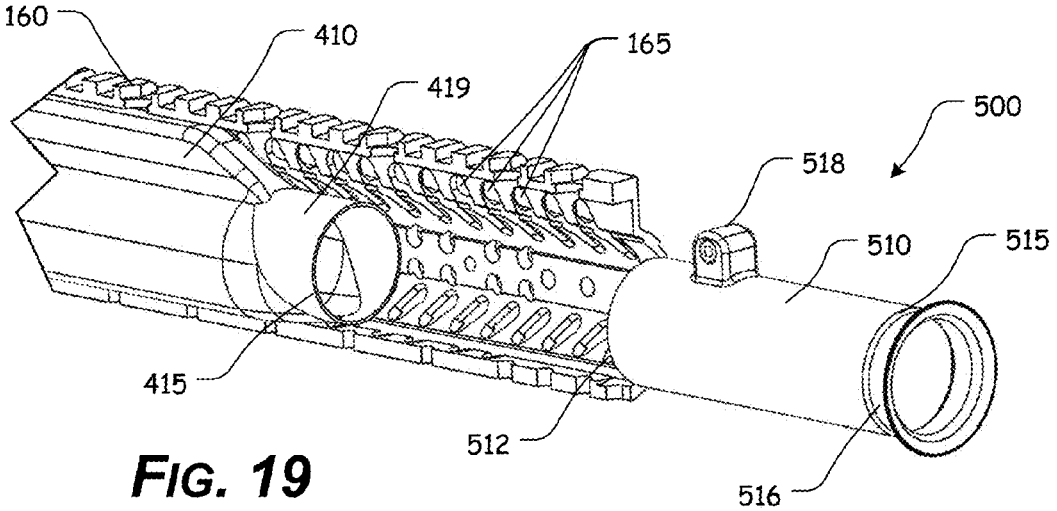
FIG. 19 illustrates a right, front perspective, partial cutaway view of an exemplary embodiment of an extension tube being aligned with and partially positioned relative to a heat shielding element and handguard, according to the present disclosure.
Figure 20:
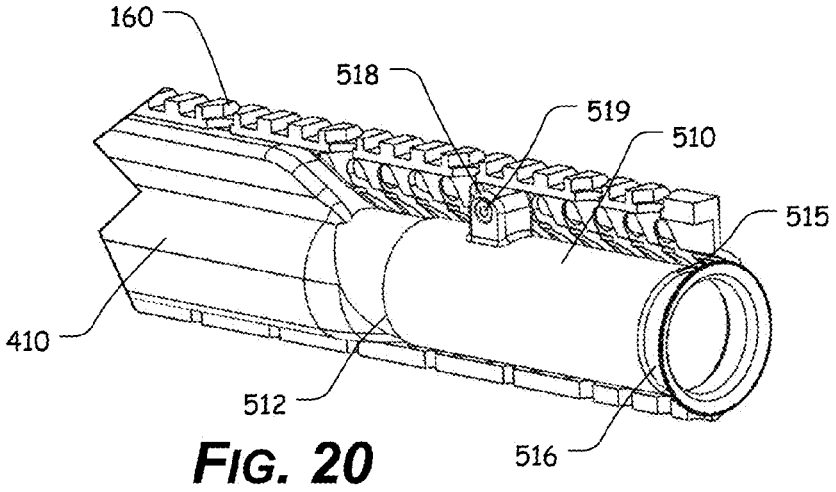
FIG. 20 illustrates a right, front perspective, partial cutaway view of an exemplary embodiment of an extension tube aligned with and positioned relative to a heat shielding element and handguard, according to the present disclosure.
Figure 21:
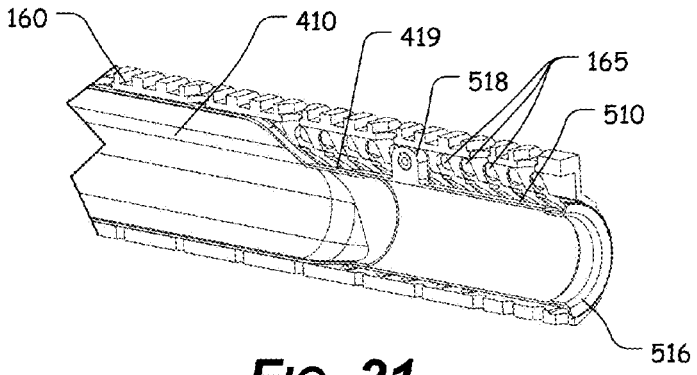
FIG. 21 illustrates a right, front perspective, cutaway view of an exemplary embodiment of an extension tube aligned with and positioned relative to a heat shielding element and handguard, according to the present disclosure.
Figure 22:
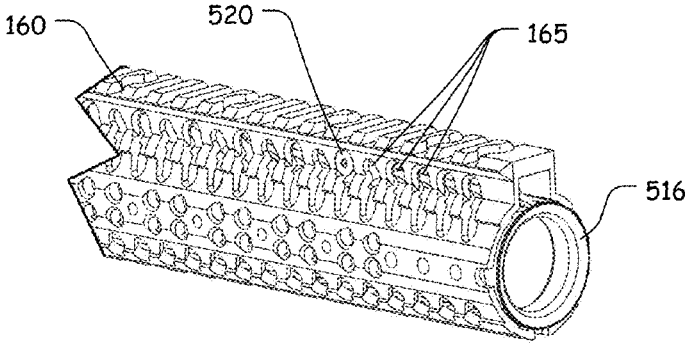
FIG. 22 illustrates a right, front perspective, view of an exemplary embodiment of an extension tube aligned with and positioned relative to a heat shielding element and handguard, according to the present disclosure.
Figure 23:
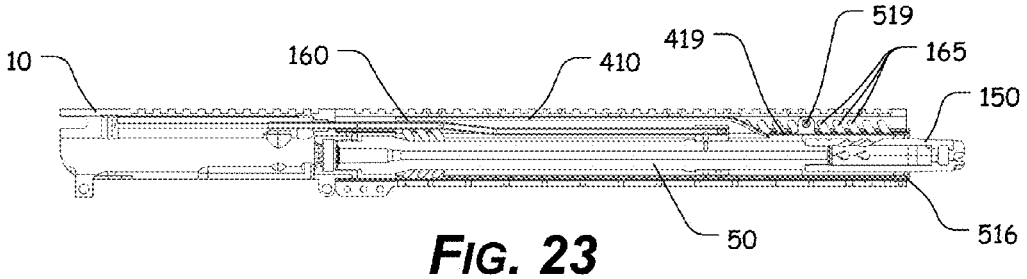
FIG. 23 illustrates a right side view of an exemplary embodiment of an extension tube aligned with and positioned relative to a heat shielding element, handguard, barrel, and muzzle device, according to the present disclosure.
Figure 24:
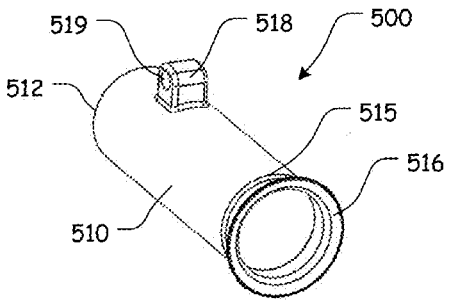
FIG. 24 illustrates a front perspective view of an exemplary embodiment of an extension tube, according to the present disclosure.
Figure 25:
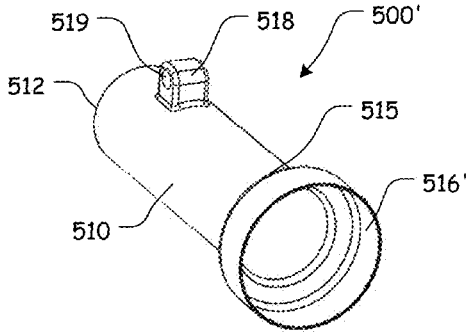
FIG. 25 illustrates a front perspective view of an exemplary embodiment of an extension tube, according to the present disclosure.
Figure 26:
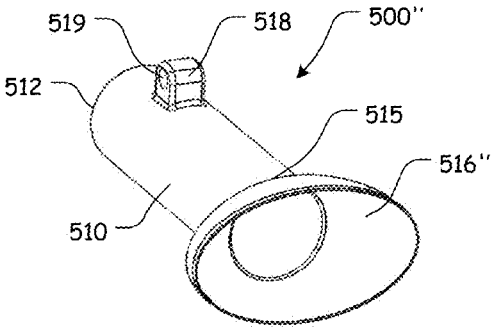
FIG. 26 illustrates a front perspective view of an exemplary embodiment of an extension tube, according to the present disclosure.
Figure 27:
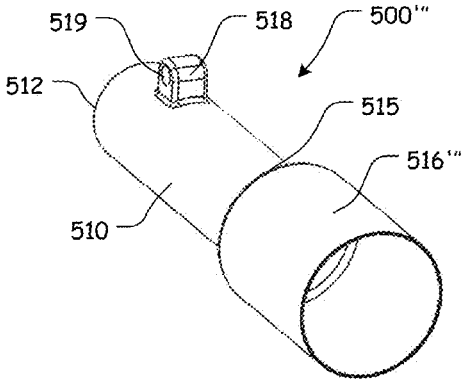
FIG. 27 illustrates a front perspective view of an exemplary embodiment of an extension tube, according to the present disclosure.
Figure 28:
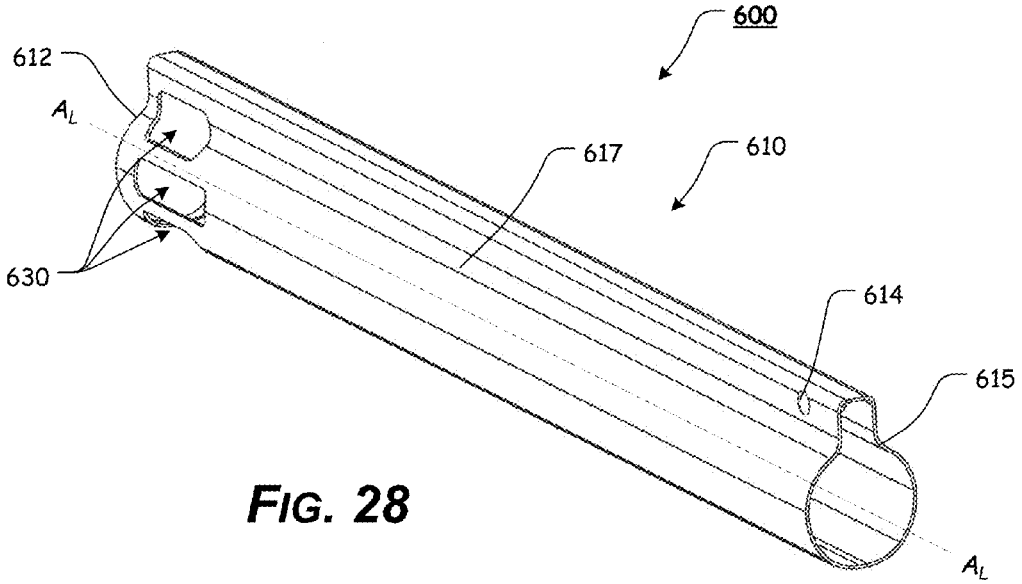
FIG. 28 illustrates a right, front perspective view of an exemplary embodiment of a heat shielding and thermal venting system, according to the present disclosure.
Figure 29:
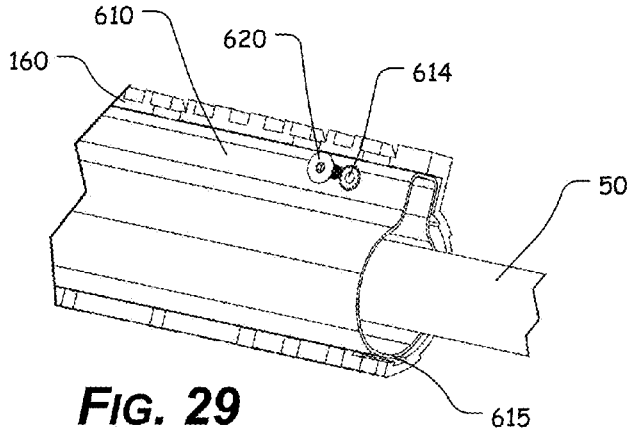
FIG. 29 illustrates a partial right, front perspective cutaway view of an exemplary embodiment of a heat shielding and thermal venting system being aligned with an exemplary handguard, according to the present disclosure.
Figure 30:
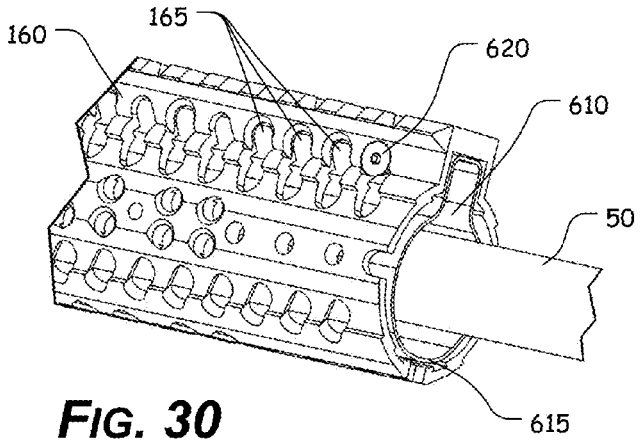
FIG. 30 illustrates a partial right, front perspective view of an exemplary embodiment of a heat shielding and thermal venting system being aligned with an exemplary handguard, according to the present disclosure.
Figure 31:
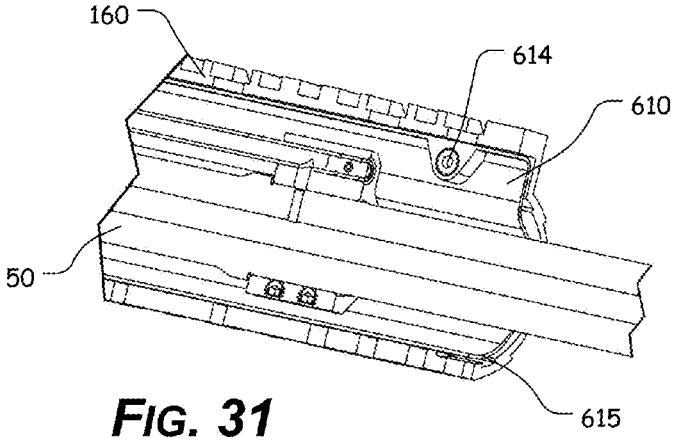
FIG. 31 illustrates a partial right, front perspective further cutaway view of an exemplary embodiment of a heat shielding and thermal venting system being aligned with an exemplary handguard, according to the present disclosure.
Figure 32:
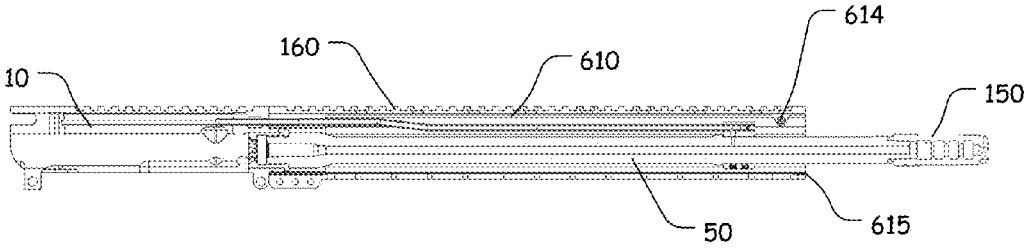
FIG. 32 illustrates a right, side cutaway view of an exemplary embodiment of a heat shielding and thermal venting system being aligned with an exemplary handguard, according to the present disclosure.
Figure 33:
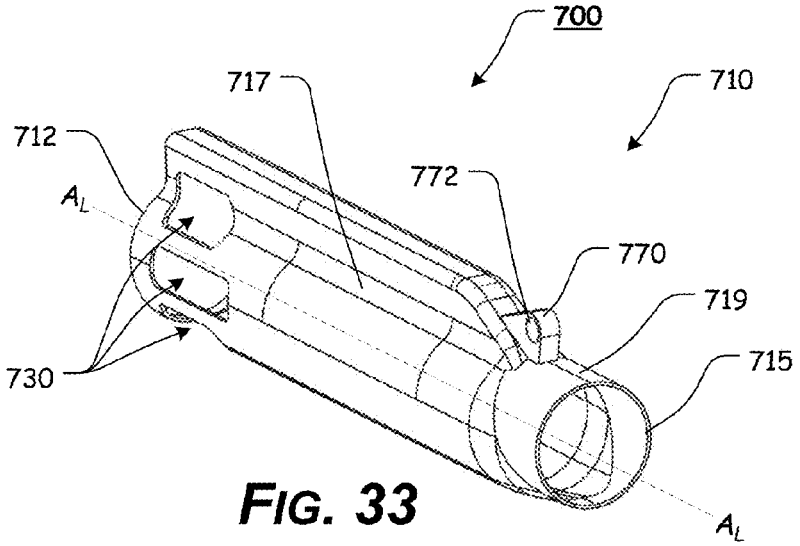
FIG. 33 illustrates a right, front perspective view of an exemplary embodiment of a heat shielding and thermal venting system, according to the present disclosure.
Figure 34:
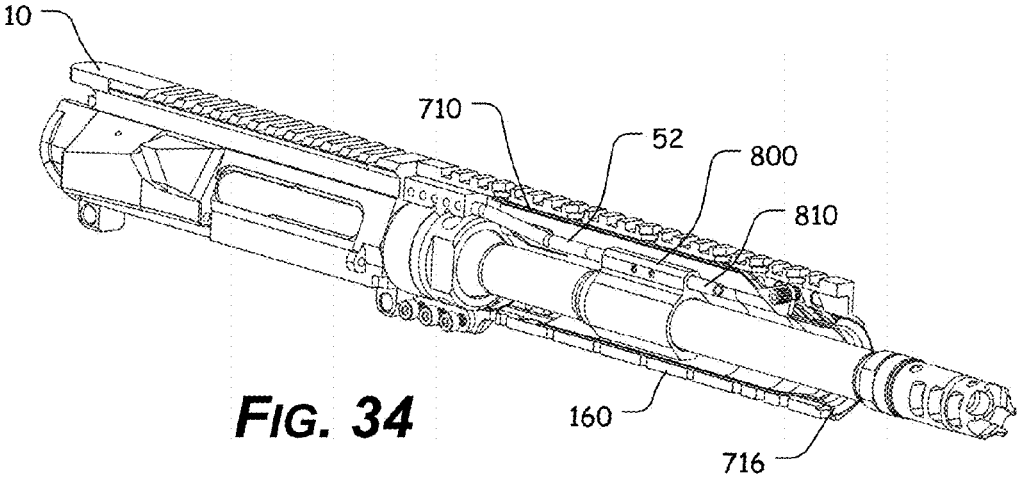
FIG. 34 illustrates a partial right, front perspective partial cutaway view of an exemplary embodiment of a heat shielding and thermal venting system being aligned with an exemplary handguard, according to the present disclosure.
Figure 35:
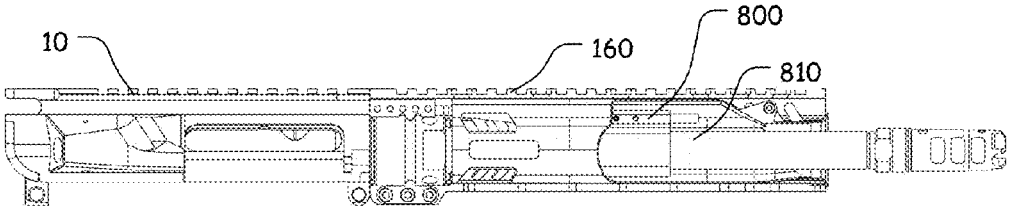
FIG. 35 illustrates a right, side partial cutaway view of an exemplary embodiment of a heat shielding and thermal venting system being aligned with an exemplary handguard, according to the present disclosure.

As illustrated most clearly in in FIG. 18, in certain exemplary, nonlimiting embodiments, the one or more entry apertures 130, 230, 330, and/or 430 may not be included. In these embodiments, the heat shielding element 410' may be positioned relative to the handguard 160, the barrel 50, and/or the barrel nut 70 so as to provide a gap 430' aft of the first end 412'. In this manner, ambient, external air is able to enter into the cavity of the heat shielding element 410' via the gap 430'.

FIGS. 19-27 illustrate various exemplary embodiments of nozzle elements that can be utilized with the heat shielding and thermal venting systems of the present disclosure. As illustrated in FIGS. 19-27, an exemplary nozzle element 500 comprises a substantially tubular nozzle body 510, which extends from a first end 512 to a second end 515. A flare portion 516 extends from the second end 515 and a nozzle attachment protrusion 518 is formed in or extends from at least a portion of the nozzle body 510.

An inner diameter of at least a portion of the first end 512 of the nozzle body 510 is formed so as to be attached or coupled to the second end 415 of the heat shielding element 410. In various exemplary embodiments, the nozzle element 500 is slidably, frictionally attached to at least a portion of the second end 415 of the heat shielding element 410. Alternatively, mating internal threads of the nozzle body 510 and external threads of the second end 415 of the heat shielding element 410 may be used utilized to threadedly attach or screw the nozzle element 500 to the heat shielding element 410. Alternatively or in addition, the nozzle element 500 may be attached or coupled to the heat shielding element 410 by various methods, such as by mere frictional engagement, adhesives, screws, pins, or other fasteners.

In certain exemplary, nonlimiting embodiments, the nozzle element 500 may be additionally or exclusively maintained in position relative to the heat shielding element 410 and/or the handguard 160 through use of one or more mounting bolts or screws 520 positioned through the nozzle attachment aperture 519 formed in the nozzle attachment protrusion 518 and properly aligned apertures 165 formed in the handguard 160. In these exemplary embodiments, the mounting bolts or screws 520 are positioned so as to be received through at least a portion of a handguard aperture 165 aligned with the nozzle attachment aperture 519. In certain exemplary embodiments, a mounting bolt or screw 520 may only extend through an aligned handguard aperture 165 and the nozzle attachment aperture 519. Alternatively, a mounting bolt or screw 520 may extend through an aligned handguard aperture 165 on a first side of the handguard 160, through the nozzle attachment aperture 519, and through at least a portion of an aligned handguard aperture 165 on a second side of the handguard 160.

The nozzle attachment aperture 519 may comprise a substantially smooth aperture formed through the nozzle attachment protrusion 518. Alternatively, the nozzle attachment aperture 519 may comprise a fully or partially internally threaded aperture.

The nozzle attachment protrusion 518 provides a portion of material that helps to isolate the nozzle body 510 from the handguard 160. Thus, by attaching or coupling the nozzle element 500 to the handguard 160, via the nozzle attachment protrusion 518, potential heat transfer from the nozzle element 500 (and/or from the mounting bolt or screw 520) to the handguard 160 is reduced.

The nozzle element 500 may be provided having different sizes, shapes, and links. Additionally, the size and shape of the flare portion 516 may vary so that the nozzle element 500 may be used in conjunction with a variety of muzzle devices and/or provide a variety of desired effects. FIGS. 24-27 illustrate certain exemplary embodiments of a variety of nozzle elements 500, 500', 500", and 500'''. As illustrated, each of the nozzle elements 500, 500', 500", and 500''' comprises a substantially tubular nozzle body 510, which extends from a first end 512 to a second end 515, a nozzle attachment protrusion 518, and a nozzle attachment aperture 519. These elements are as described above, with reference to the nozzle element 500 of FIGS. 19-23.

However, as illustrated in FIGS. 24-27, each of the flare portions 516, 516', 516", and 516''' has a slightly different overall size, shape, and/or profile.

It should be appreciated that the overall size, shape, and/or profile of a nozzle element and/or flare portion is a design choice based upon the desired appearance and/or effect provided by the nozzle element. Thus, the Illustrated flare portions 516, 516', 516", and 516''' should be viewed as exemplary and not limiting the present disclosure.

FIGS. 28-32 illustrate an exemplary embodiment of a heat shielding and thermal venting system 600, according to the present disclosure. As illustrated in FIGS. 28-32, the heat shielding and thermal venting system 600 comprises at least some of a heat shielding element 610 extending from a first end 612 to a muzzle end or second end 615, a primary portion 617, and one or more entry apertures 630. Additionally, the heat shielding element 610 may optionally include one or more restricted portions 618 (not shown).

It should be understood that each of these elements corresponds to and operates similarly to the correspondingly named elements, as described above with reference to the heat shielding and thermal venting systems 100, 200, 300, and/or 400.

However, as illustrated in FIGS. 28-32, the primary portion 617 extends the entire length of the heat shielding element 610, from the first end 612 to the second end 615. Additionally, a heat shielding element attachment aperture 614 is formed proximate the second end 615 of the heat shielding element 610. The heat shielding element attachment apertures 614 provides a mounting area or means.

Thus, through use of the heat shielding attachment aperture 614, the heat shielding element 610 may be additionally or exclusively maintained in position relative to the handguard 160 through use of one or more mounting bolts or screws 620 positioned through the heat shielding element attachment apertures 614 formed in the heat shielding element 610 and properly aligned apertures 165 formed in the handguard 160.

In these exemplary embodiments, the mounting bolts or screws 620 are positioned so as to be received through at least a portion of a handguard aperture 165 aligned with the heat shielding element attachment apertures 614. In certain exemplary embodiments, a mounting bolt or screw 620 may only extend through an aligned handguard aperture 165 and the heat shielding element attachment aperture(s) 614. Alternatively, a mounting bolt or screw 620 may extend through an aligned handguard aperture 165 on a first side of the handguard 160, through the heat shielding element attachment apertures 614, and through at least a portion of an aligned handguard aperture 165 on a second side of the handguard 160.

The heat shielding element attachment apertures 614 may comprise a substantially smooth aperture formed through the heat shielding element 610. Alternatively, the heat shielding element attachment apertures 614 may comprise a fully or partially internally threaded aperture.

FIGS. 33-38 illustrate an exemplary embodiment of a heat shielding and thermal venting system 700, according to the present disclosure. As illustrated in FIGS. 33-38, the heat shielding and thermal venting system 700 comprises at least some of a heat shielding element 710 extending from a first end 712 to a muzzle end or second end 715, an optional flare portion 716, a primary portion 717, a secondary portion 719, and one or more entry apertures 730. Additionally, the heat shielding element 710 may optionally include one or more restricted portions 718 (not shown).

It should be understood that each of these elements corresponds to and operates similarly to the correspondingly named elements, as described above with reference to the heat shielding and thermal venting systems 100, 200, 300, and/or 400.

As illustrated in FIGS. 33-38, the entry apertures 730 optionally comprise a plurality of substantially rectangular apertures formed through the heat shielding element 710 proximate the first end 712. Additionally, a substantially smooth transition is provided between the primary portion 717 and the secondary portion 719, providing for enclosure of the firearms gas block and gas tube.

It should be appreciated that the heat shielding element 710 (as with the heat shielding elements 110, 210, 310, and/or 410), may be provided in any desired length or overall external or internal profile. It should also be appreciated that the heat shielding element 710 may be configured so as to optionally be attached or coupled to a nozzle element 500, 500', 500", and/or 500'".

As illustrated, the heat shielding element 710 also includes a heat shielding element attachment protrusion 770 formed in or extending from at least a portion of the heat shielding element 710. At least one heat shielding element attachment aperture 772 is formed through or at least partially through the heat shielding element attachment protrusion 770.

During installation, the heat shielding element 710 is initially aligned with and then inserted within the interior cavity of the handguard 160. Once appropriately positioned within the handguard 160, the heat shielding element 710 is maintained in position relative to the handguard 160 through use of one or more mounting bolts or screws 720 (not shown) positioned through the heat shielding element attachment aperture 772 formed in the heat shielding element attachment protrusion 770 and properly aligned apertures 165 formed in the handguard 160. In these exemplary embodiments, the mounting bolts or screws 720 (not shown) are positioned so as to be received through at least a portion of a handguard aperture 165 aligned with the heat shielding element attachment aperture 772.

In certain exemplary embodiments, a mounting bolt or screw 720 (not shown) may only extend through an aligned handguard aperture 165 and the heat shielding element attachment aperture 772. Alternatively, a mounting bolt or screw 720 (not shown) may extend through an aligned handguard aperture 165 on a first side of the handguard 160, through the heat shielding element attachment aperture 772, and through at least a portion of an aligned handguard aperture 165 on a second side of the handguard 160.

The heat shielding element attachment aperture 772 may comprise a substantially smooth aperture formed through the heat shielding element attachment protrusion 770. Alternatively, the heat shielding element attachment aperture 772 may comprise a fully or partially internally threaded aperture.

The heat shielding element attachment protrusion 770 provides a portion of material that helps to isolate the heat shielding element 710 from the handguard 160. Thus, by attaching or coupling the heat shielding element 710 to the handguard 160, via the heat shielding element attachment protrusion 770, potential heat transfer from the heat shielding element 710 (and/or from the mounting bolt or screw 720 (not shown)) to the handguard 160 is reduced.

As further illustrated in FIGS. 34-38, the heat shielding and thermal venting system 700 utilizes a gas block 800 as part of the air circulation system within the cavity of the heat shielding element 710. In various exemplary embodiments, the gas block 800 includes a gas block injector system comprising a pulse injector 805 that diverts a portion of exhaust gas that would traditionally be diverted through the gas tube 52 and delivers a pulse of exhaust gas pressure forward, through one or more nozzles 810, into the cavity of the heat shielding element 710 as the firearm is fired. The delivered pulse of exhaust gas further increases and/or creates the Venturi effect within the heat shielding element 710 and further assists in drawing cool air forward, through the interior cavity of the heat shielding element 710. Conservation of momentum means that as air moves through the cavity of the heat shielding element 710, fresh or ambient outside air is drawn into the cavity of the heat shielding element 710.

Figure 36:
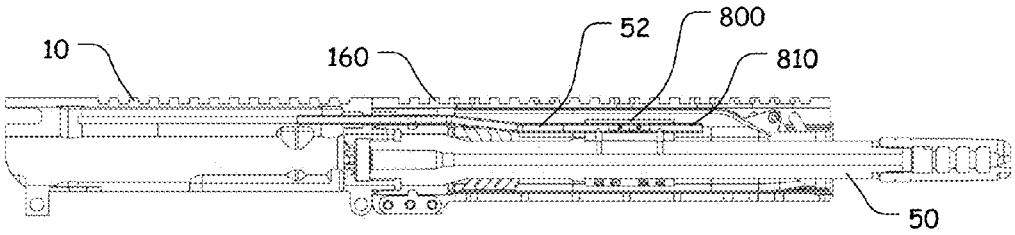
FIG. 36 illustrates a right, side cutaway view of an exemplary embodiment of a heat shielding and thermal venting system being aligned with an exemplary handguard, according to the present disclosure.
Figure 37:
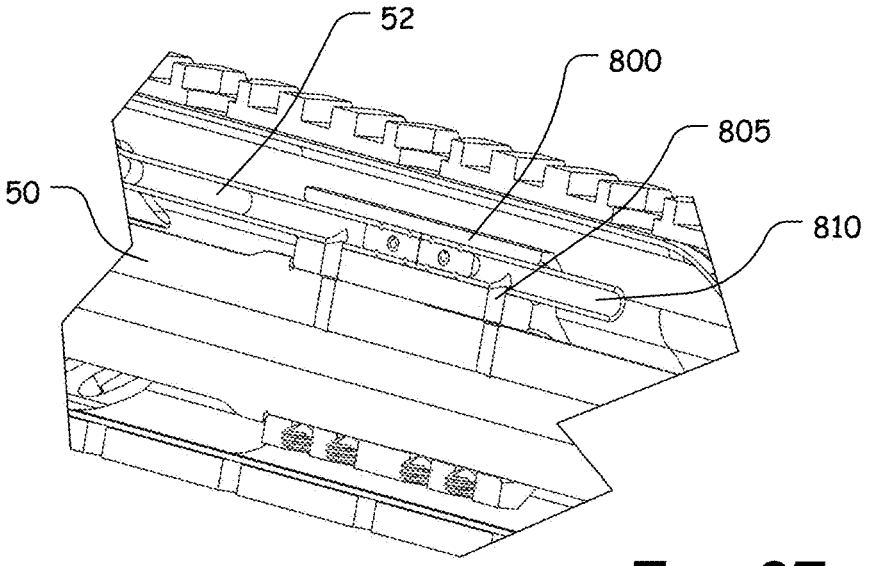
FIG. 37 illustrates a right, side cutaway view of certain components of an exemplary embodiment of a gas block injector system aligned with an exemplary handguard, according to the present disclosure.

As illustrated in FIGS. 36-37, the gas block 800 uses dual gas port holes and two, corresponding apertures are drilled in the barrel to a determined size that is dependent on barrel length. In various exemplary embodiments, a shortened gas tube is used instead of a full-length gas tube.

Utilizing gas energy to move air through the heat shielding element 710 can produce conservation of momentum. For example, the gas block 800 may be used to direct propellant gas forwards as well as backwards. Propellant gas directed backward can be used, for example, to cycle the bolt carrier group of the firearm.

The forward venting gas block 800 sends at least a portion of the exhaust gas down the heat shielding element 710 towards the muzzle of the firearm and induces a venture effect that causes relatively cooler atmospheric air to be drawn into the heat shielding element 710, through the one or more entry apertures 730, to travel down the length of the featuring element 710, behind the forward venting exhaust gas. This suction effect assists in cooling while the extra gas utilized in the operation softens the operating action of the firearm by reducing gas pressure, especially on shorter, more aggressive gas systems.

In various exemplary embodiments, the nozzle(s) 810 may be pointed forward, parallel to the longitudinal axis of the barrel or heat shielding element 710. Alternatively, the nozzle(s) 810 may be pointed at slightly different angles to create a vortex effect of air inside the heat shielding element 710.

Figure 38:
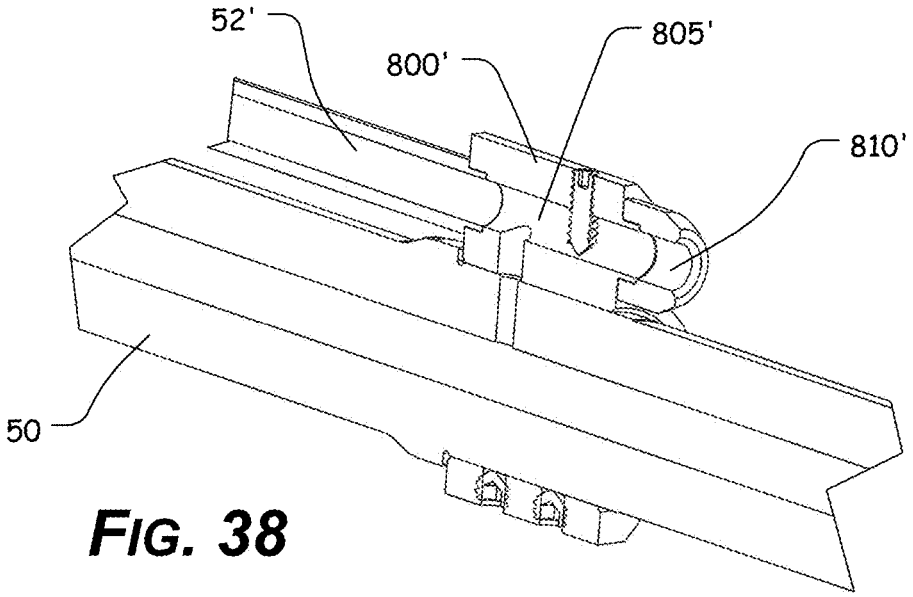
FIG. 38 illustrates a right, side cutaway view of certain components of an exemplary embodiment of a gas block injector system, according to the present disclosure.
Figure 39:
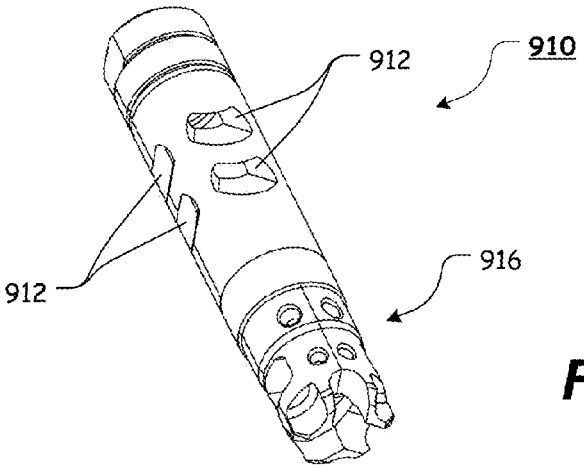
FIG. 39 illustrates a front perspective view of an exemplary embodiment of a muzzle device, according to the present disclosure.
Figure 40:
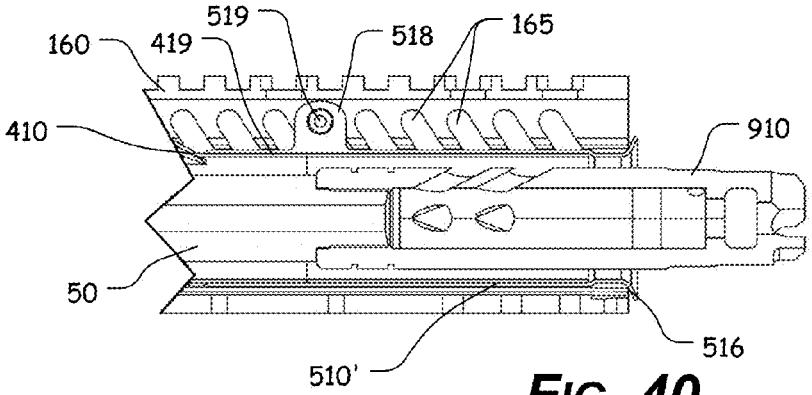
FIG. 40 illustrates a right, side partial cutaway view of an exemplary embodiment of a muzzle device utilized in conjunction with an exemplary extension tube and handguard, according to the present disclosure.
Figure 41:
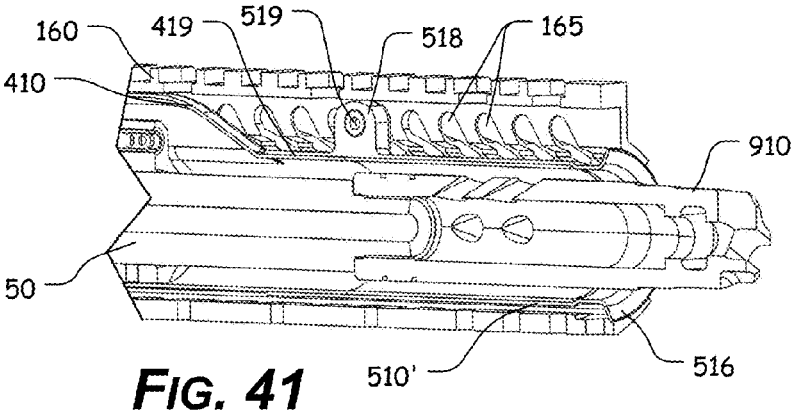
FIG. 41 illustrates a right side perspective, partial cutaway view of an exemplary embodiment of a muzzle device utilized in conjunction with an exemplary extension tube and handguard, according to the present disclosure.

Alternatively, as illustrated most clearly in FIG. 38, the pulse injector 805' may be incorporated into a modified gas block 800'. In these exemplary embodiments, the modified gas block 800' may be used in combination with a modified gas tube 52', having an open end that allows exhaust gas to flow in both directions front and back. Thus, the pulse injector 805' may be a component of a stand-alone injector gas block 800' with one or more injector nozzles 810'. Furthermore, the barrel 50 may have one, two, or more holes to feed exhaust gas to the modified gas block 800'.

An adjustment device, such as, for example, an adjustment screw 807' may be positioned within at least a portion of the pulse injector 805' to meter the flow of forward ported gas down the heat shielding element 710 or the handguard 160. By adjustment of the adjustment screw 807', the amount of exhaust gas pressure delivered through the one or more injector nozzles 810', in each pulse, can be adjusted, as desired.

FIGS. 39-49 illustrate various exemplary embodiments of muzzle devices 910, 910', 920, 920', and 930, according to the present disclosure. As illustrated in FIGS. 39-49, the muzzle devices 910, 910', 920, 920', and 930 each comprise one or more angled exhaust ports 912, 922, and 932, respectively. The angled exhaust ports 912, 922, and 932 allow fluid communication between an interior and an exterior of the muzzle devices 910, 910', 920, 920', and 930, respectively.

In various exemplary embodiments, the one or more angled exhaust ports 912, 922, and 932 are angled so as to divert a portion of the blast gases that are created during a firing cycle to exit the angled exhaust ports 912, 922, and 932 into the interior of the heat shielding element 410 at a forward facing angle to create a vacuum or air pressure differential behind the blast such that a Venturi Effect can be enhanced or created, causing air to move through the heat shielding element 410, behind the vectored blast gas.

In various exemplary embodiments, certain of the muzzle devices, such as, for example, muzzle devices 920 and 920' optionally include a plurality of radial teeth 924, that extend, at spaced apart locations, from the outside surfaces of the muzzle devices 920 and 920'. The radial teeth 924, if included, operate to disrupt the blast gas as it exits the heat shielding element 410.

It should be appreciated that the muzzle devices 910, 910', 920, 920', and 930 may be muzzle brakes, flash hiders, silencer mounts, or combination of the foregoing. Thus, the muzzle devices 910, 910', 920, 920', and 930 may include a variety of muzzle device extension portions 916, 916', 926, 926', and 936, respectively. Each of the muzzle device extension portions (or other, non-illustrated muzzle device extension portions) can provide a desired function, such as, for example, dissipation or vectoring of exhaust gases.

It should be appreciated that while the muzzle devices 910, 910', 920, 920', and 930 are illustrated as being used in conjunction with a heat shielding element 410 and nozzle body 510', these are merely exemplary heat shielding elements and nozzle bodies. Thus, it should be appreciated that each of the muzzle devices 910, 910', 920, 920', and 930 may optionally be used in conjunction with any of the embodiments of the heat shielding elements, with or without an associated nozzle body.

Figure 42:
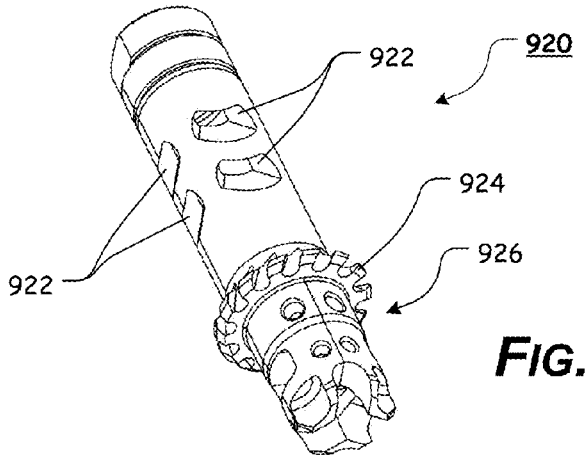
FIG. 42 illustrates a front perspective view of an exemplary embodiment of a muzzle device, according to the present disclosure.
Figure 43:
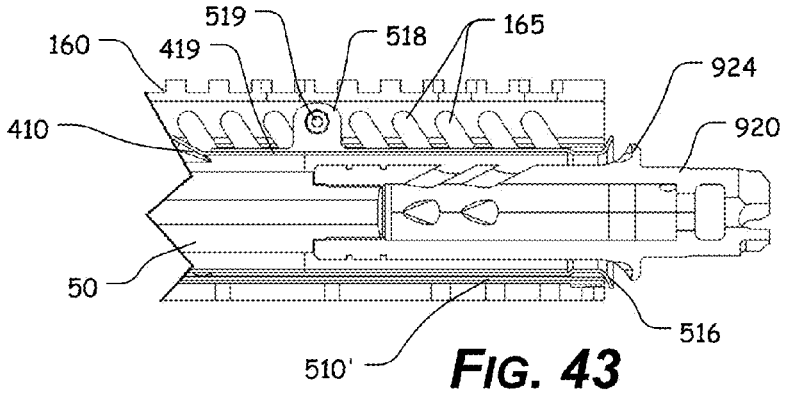
FIG. 43 illustrates a right, side partial cutaway view of an exemplary embodiment of a muzzle device utilized in conjunction with an exemplary extension tube and handguard, according to the present disclosure.
Figure 44:
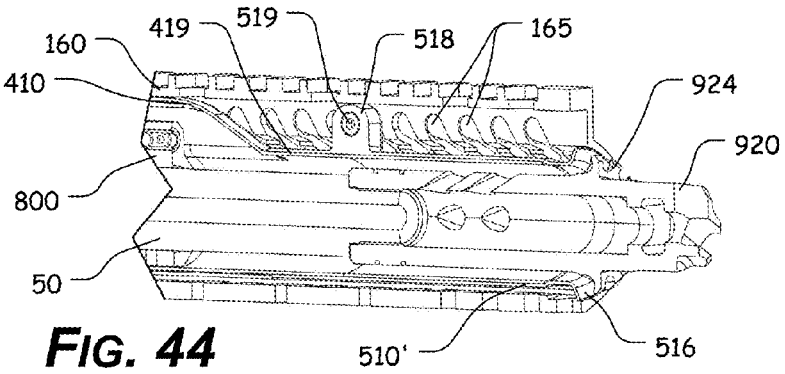
FIG. 44 illustrates a right side perspective, partial cutaway view of an exemplary embodiment of a muzzle device utilized in conjunction with an exemplary extension tube and handguard, according to the present disclosure.
Figure 45:
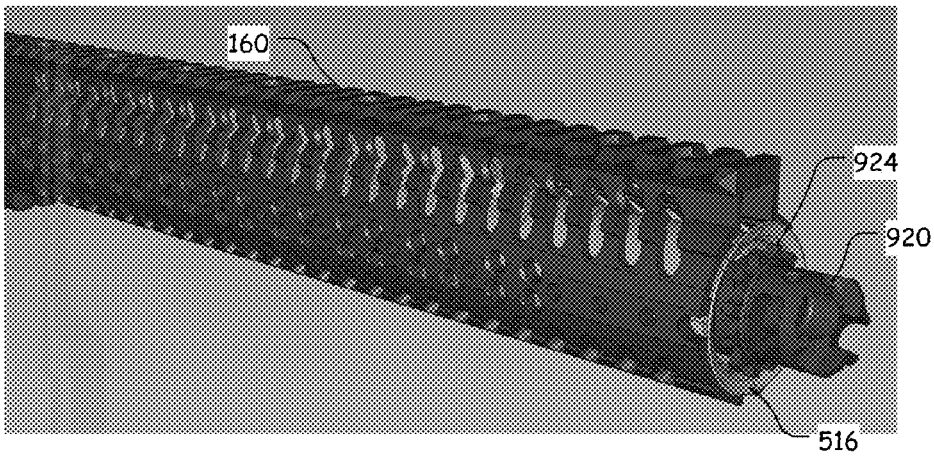
FIG. 45 illustrates a right side perspective view of an exemplary embodiment of a muzzle device utilized in conjunction with an exemplary extension tube and handguard, according to the present disclosure.
Figure 46:
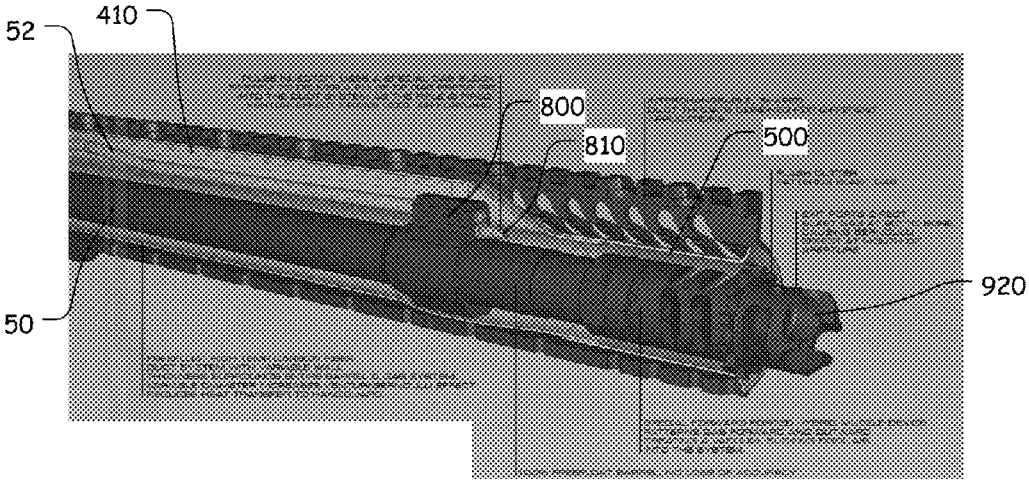
FIG. 46 illustrates a right side, partial cutaway perspective view of an exemplary embodiment of a muzzle device utilized in conjunction with an exemplary extension tube and handguard, according to the present disclosure.
Figure 47:
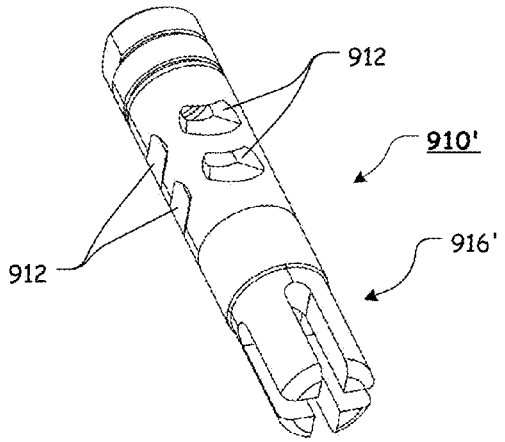
FIG. 47 illustrates a front perspective view of an exemplary embodiment of a muzzle device, according to the present disclosure.
Figure 48:
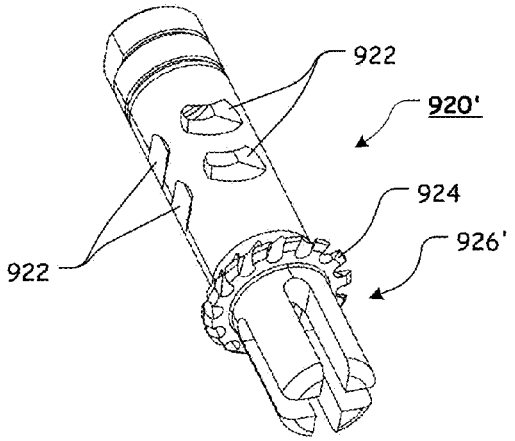
FIG. 48 illustrates a front perspective view of an exemplary embodiment of a muzzle device, according to the present disclosure.
Figure 49:
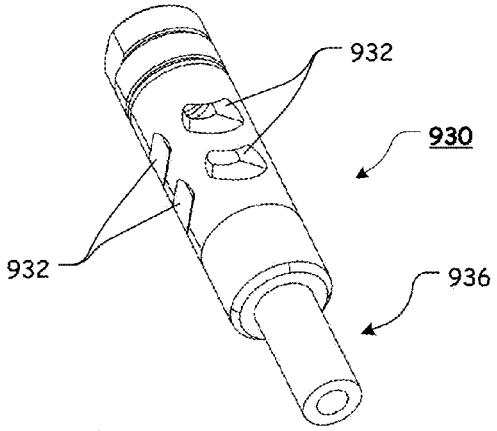
FIG. 49 illustrates a front perspective view of an exemplary embodiment of a muzzle device, according to the present disclosure.

For example, as illustrated in FIGS. 42-44, the heat shielding and thermal venting system 400 includes a heat shielding element 410 comprising a free float high-temperature carbon fiber material having variable wall thicknesses and variable diameter, which surrounds the entire barrel 50, gas tube 52, and gas block 800. The variable diameter increases the Venturi/Bernoulli Effect within the cavity of the heat shielding element 410 and further reduces heat transfer to the handguard 160.

The nozzle body 510' is removable and replaceable and can be interchangeable such that the shape of the flare portion 516 can be altered for different applications. It should be appreciated that the flare portion 616 may be formed independently from the heat shielding element 410 and may be attached or coupled to the heat shielding element 410 by various methods, such as by frictional engagement, adhesives, welding, screws, rivets, pins, or other fasteners, to form a composite heat shielding element 410.

The muzzle device 920 comprises a forward ported hybrid muzzle device that patterns gas forward and outward, creating a vacuum within the cavity of the heat shielding element 410 and/or flare portion 516.

A flash cutter, comprising a series of alternating protrusions and valleys surrounds at least a portion of the muzzle device 920. The flash cutter helps to further pattern the expelled exhaust gases in a desired direction.

Various exhaust ports of the muzzle device 920 direct the exhaust gasses in a desired direction (such as, for example, 25°, 30°, 35°, 40°, or 45° to the longitudinal or bore axis of the barrel 50) to further enhance Bernoulli effect of the flare portion 516.

Thus, the barrel 50 and muzzle device 920 remain free floated at all times and the forward angled exhaust ports 922 on the muzzle device 920 may optionally be position on the top and sides of the muzzle device 920 only, so that exhaust gas does not exit from the lower portion. This effect drives the barrel 50 down and combats muzzle rise from firing the weapon.

Figure 50:
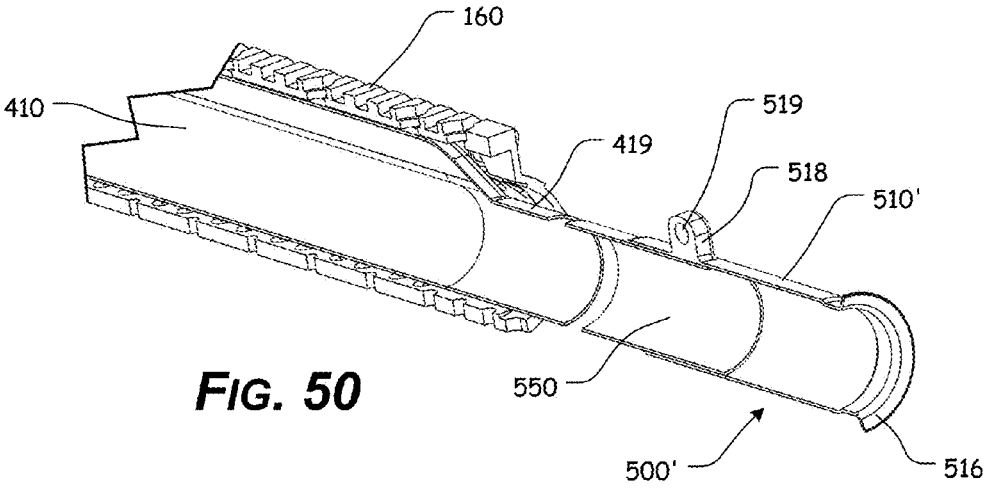
FIG. 50 illustrates a right, front perspective, partial cutaway view of an exemplary embodiment of an extension tube and an nozzle element being aligned with and partially positioned relative to a heat shielding element and handguard, according to the present disclosure.

FIG. 50 illustrates a cutaway front perspective view of an exemplary embodiment of an alternate nozzle element 500', according to the present disclosure. As illustrated in FIG. 50, the nozzle element 500' corresponds to and operates similarly to the nozzle element 500, as described herein.

However, as illustrated in FIG. 50, a portion of the interior of the nozzle element 500' expands to a larger interior diameter so as to allow a cylindrical insert 550 to be fully or partially seated within the interior of the nozzle element 500'. In various exemplary embodiments, the cylindrical insert 550 comprises a circular section of steel or other material. Thus, when inserted inside at least a portion of the nozzle element 500', the cylindrical insert 550 acts to protect the interior of the nozzle element 500' from blast gas erosion.

In various exemplary embodiments, the cylindrical insert 550 may be removed and replaced if it has been damaged or compromised by blast gas erosion.

Figure 51:
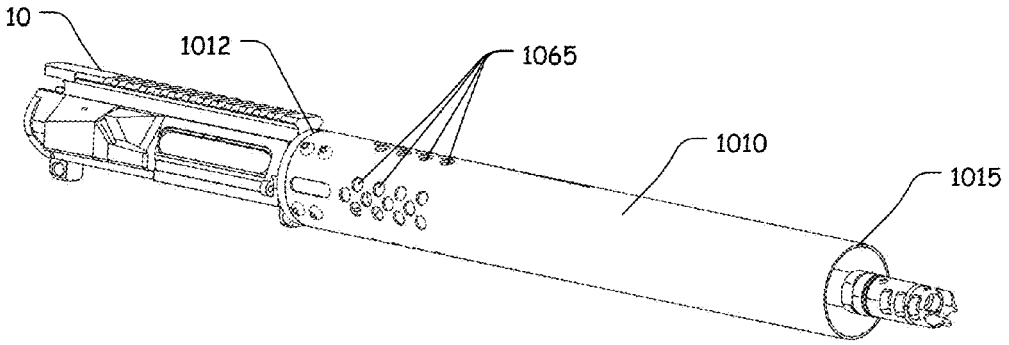
FIG. 51 illustrates a right, front perspective view of an exemplary embodiment of a heat shielding and thermal venting system, according to the present disclosure.

FIG. 51 illustrates a front perspective view of an exemplary embodiment of an alternate heat shielding element 1010, according to the present disclosure. As illustrated in FIG. 51, the heat shielding element 1010 extends from a first end 1012 to a muzzle end or second end 1015 includes and one or more entry apertures 1065, formed proximate the first end 1012.

The heat shielding element 1010 provided in a series of different lengths and configurations and may be attached or coupled to operate as a stand-alone heatshield to shield an operator's hands from at least a portion of the barrel.

The heat shielding element 1010 limits radiated heat transfer from the barrel and reduces the firearms thermal signature as viewed through FLIR (forward looking infrared) or other heat sensitive cameras.

Additionally, the one or more entry apertures 1065 allow air to move in and through the center of the heat shielding element 1010 like a chimney, stack, or flue, as further described herein with reference to alternate embodiments of the heat shielding element of the present disclosure.

Figure 52:
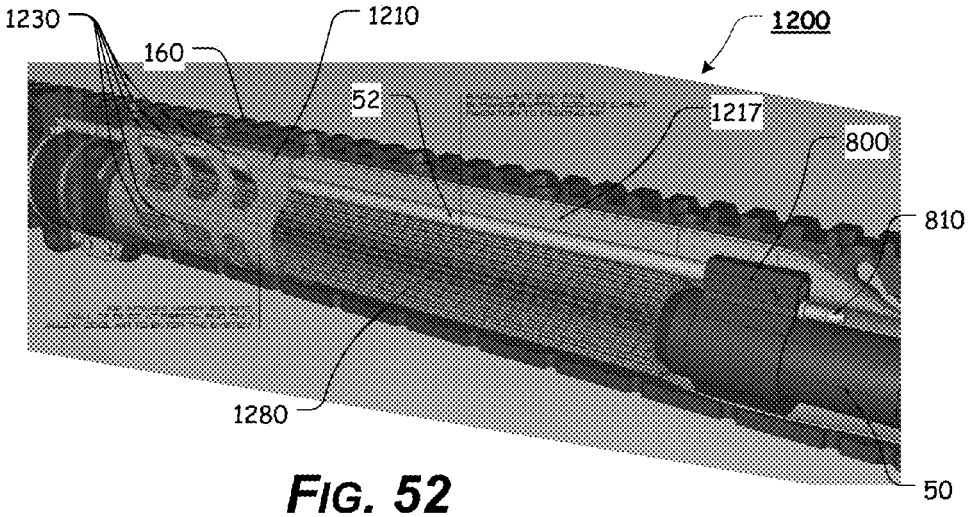
FIG. 52 illustrates a partial cutaway front perspective view of an exemplary embodiment of a heat shielding and thermal venting system and radial heat sink fins, according to the present disclosure.

FIG. 52 illustrates a partial cutaway front perspective view of an exemplary embodiment of a heat shielding and thermal venting system 1200, according to the present disclosure. As illustrated in FIG. 52, the heat shielding and thermal venting system 1200 comprises at least some of a heat shielding element 1210 extending from a first end 1212 (not shown) to a muzzle end or second end 1215 (not shown), a flare portion 1216 (not shown), a primary portion 1217, a secondary portion 1219 (not shown), and one or more entry apertures 1230. Additionally, the heat shielding element 1210 may optionally include one or more restricted portions 1218 (not shown) and/or an extended flare portion 1240 (not shown).

It should be understood that each of these elements corresponds to and operates similarly to the correspondingly named elements, as described herein.

However, as illustrated in FIG. 52, an exemplary radially finned heat sink 1280 is included, which surrounds the barrel 50 to enhance cooling and heat radiation to air passing within the cavity of the heat shielding element 1210. As illustrated, the radially finned heat sink 1280 includes a series of fins that extend radially and surround the barrel 50.

In various exemplary embodiments, the radially finned heat sink 1280 is maintained in position by engagement with the exterior of the barrel 50 and do not connect or contact the heat shielding element 1210. Thus, the barrel 50 is still free-floating within the heat shielding element 1210.

Figure 53:
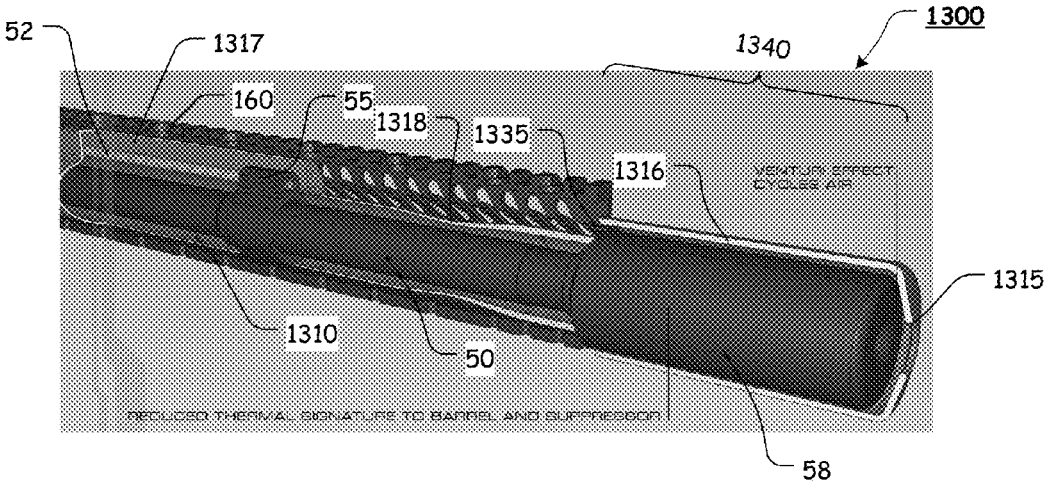
FIG. 53 illustrates a partial cutaway front perspective view of an exemplary embodiment of a heat shielding and thermal venting system, according to the present disclosure.
Figure 54:
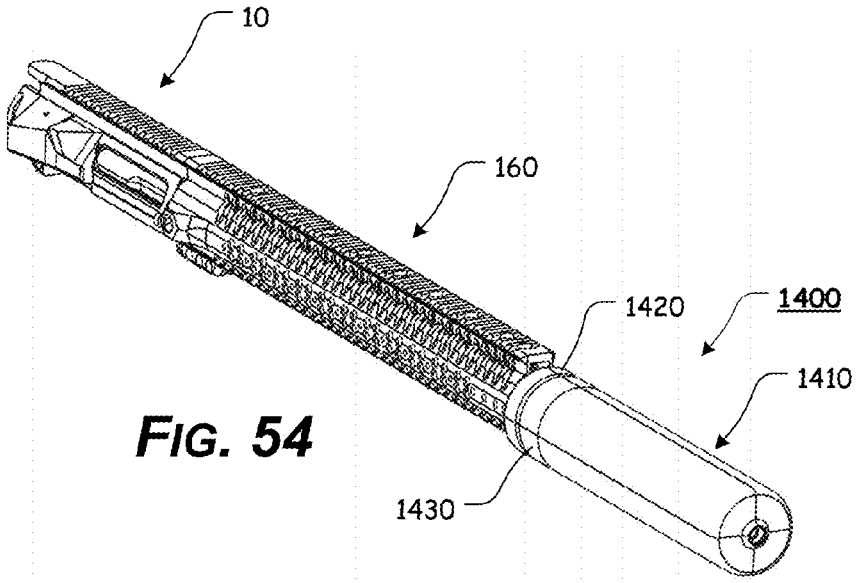
FIG. 54 illustrates a front perspective view of an exemplary embodiment of a suppressor related heat shielding and thermal venting system, according to the present disclosure.
Figure 55:
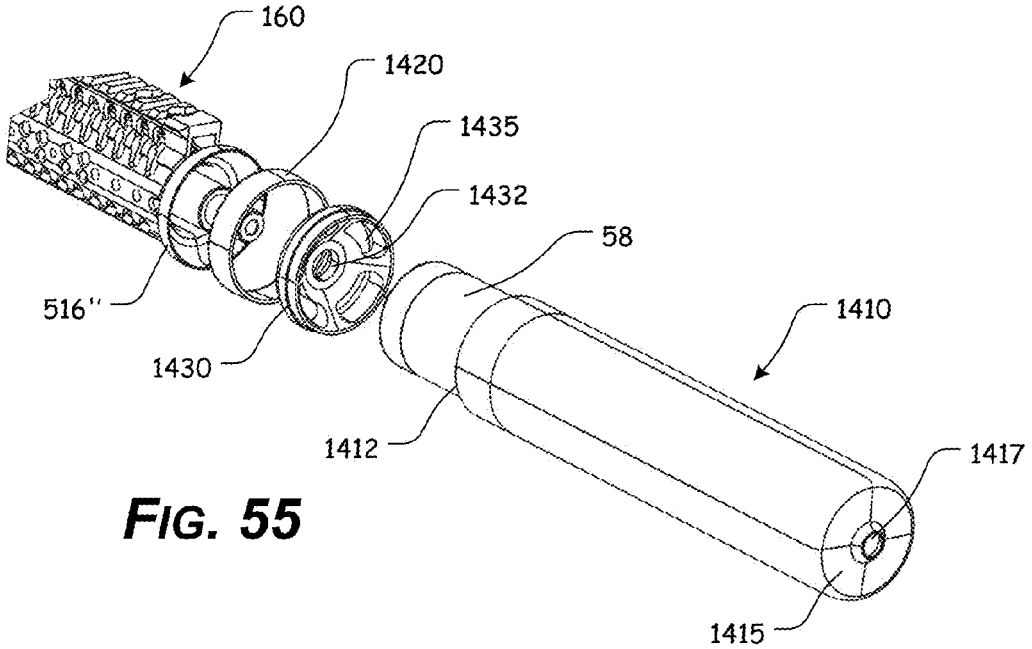
FIG. 55 illustrates a partial front perspective exploded view showing certain elements of an exemplary embodiment of a suppressor related heat shielding and thermal venting system, according to the present disclosure.
Figure 56:
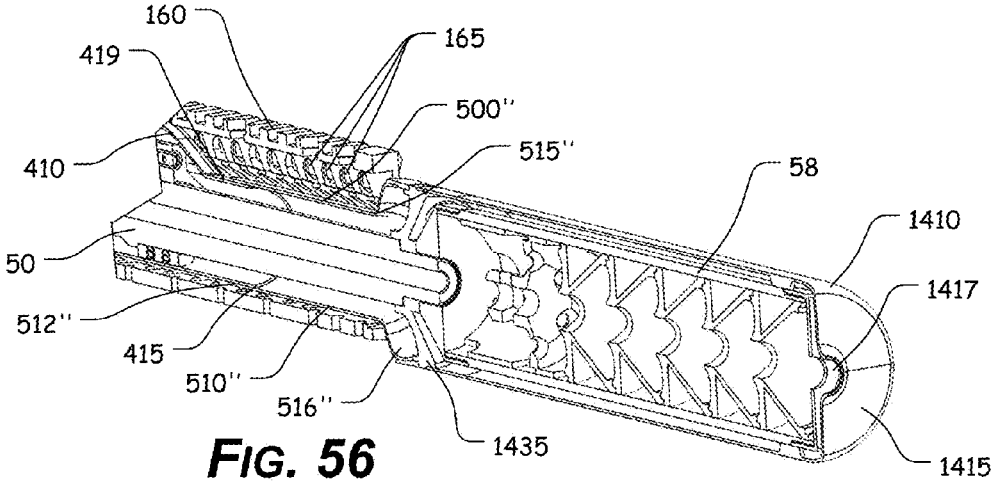
FIG. 56 illustrates a partial front perspective, cutaway view showing certain elements of an exemplary embodiment of a suppressor related heat shielding and thermal venting system, according to the present disclosure.
Figure 57:
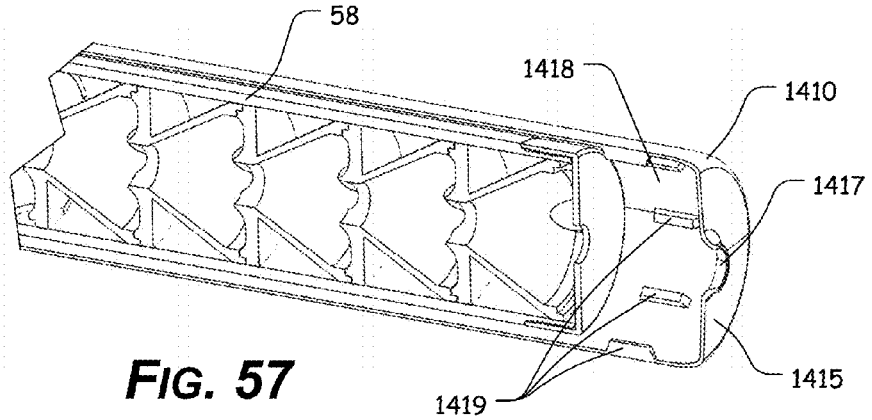
FIG. 57 illustrates a partial front perspective, more detailed cutaway view showing certain elements of an exemplary embodiment of a suppressor related heat shielding and thermal venting system, according to the present disclosure.
Figure 58:
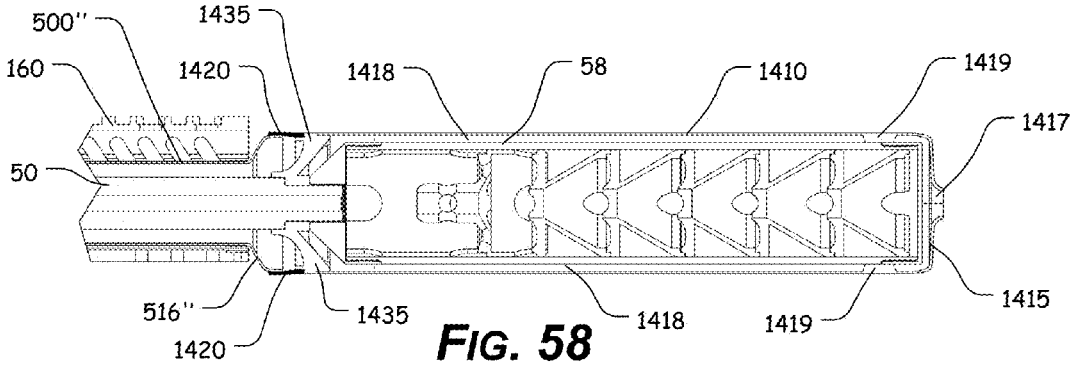
FIG. 58 illustrates a partial, side cutaway view showing certain elements of an exemplary embodiment of a suppressor related heat shielding and thermal venting system, according to the present disclosure.
Figure 59:
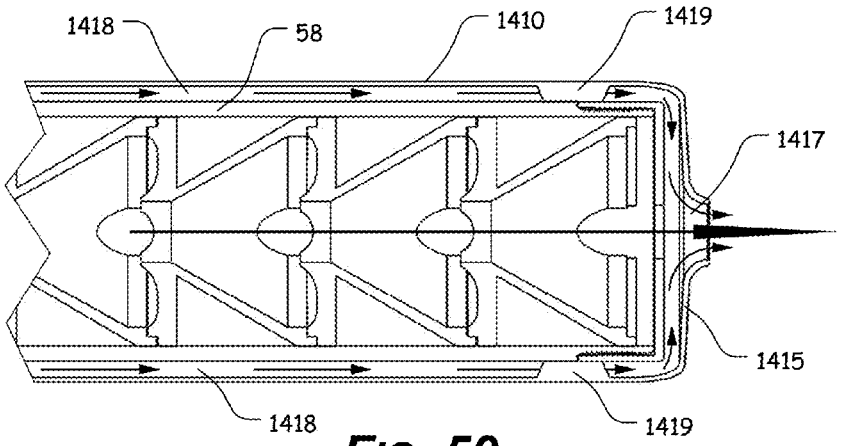
FIG. 59 illustrates a more detailed, partial side cutaway view showing certain elements of an exemplary embodiment of a suppressor related heat shielding and thermal venting system, according to the present disclosure.
Figure 60:
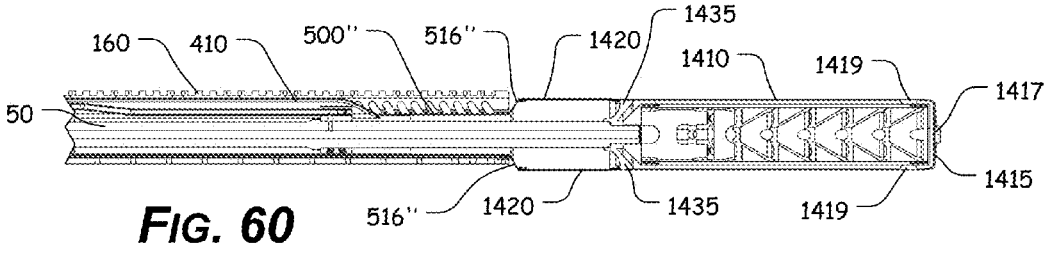
FIG. 60 illustrates a partial, side cutaway view showing certain elements of an exemplary embodiment of a suppressor related heat shielding and thermal venting system, according to the present disclosure.

FIG. 53 illustrates a partial cutaway front perspective view of an exemplary embodiment of a heat shielding and thermal venting system 1300, according to the present disclosure. As illustrated in FIG. 53, the heat shielding and thermal venting system 1300 comprises at least some of a suppressor heat shielding element 1410 extending from a first end 1312 (not shown) to a muzzle end or second end 1315, a flare portion 1316, a primary portion 1317, a secondary portion 1319, and one or more entry apertures 1330 (not shown). Additionally, the suppressor heat shielding element 1410 may optionally include one or more restricted portions 1318.

It should be understood that each of these elements corresponds to and operates similarly to the correspondingly named elements, as described herein.

However, as illustrated in FIG. 53, the flare portion 1316 extends to form an extended flare portion 1340 that encloses the sides and a portion of the front of an attached suppressor 58. By enclosing the sides and a portion of the front (leaving open an exit aperture) of the attached suppressor 58, the thermal signature of the attached suppressor 58 is reduced and/or eliminated.

In certain exemplary embodiments, one or more apertures 1335 are formed in an area between the secondary portion 1319 and the extended flare portion 1340. Alternatively, the extended flare portion 1340 may comprise any suppressor that comprises a separate component from the suppressor heat shielding element 1410.

Since the extended flare portion 1340 encases most of the suppressor 58 and the second end 1315 forms a reduced exit aperture, the exit aperture constitutes a Venturi constriction or restricted portion 1318, which can act to cause ambient air to be sucked into the one or more entry apertures 1330 and/or any apertures 1335 when the firearm is fired. An additional Venturi effect is created as air is drawn over the suppressor 58 and into the blast stream as the firearm is fired.

FIGS. 54-60 illustrate an exemplary embodiment of a heat shielding and thermal venting system 1400, according to the present disclosure. As illustrated in FIGS. 54-60, the heat shielding and thermal venting system 1400 is designed so as to operate in conjunction with a heat shielding element 410 or a heat shielding element 710, as shown and described herein.

The heat shielding and thermal venting system 1400 is also designed so as to utilize a nozzle element 500". The nozzle element 500" is formed and operates similarly to the nozzle element 500 or the nozzle element 500'. As illustrated, the nozzle element 500" comprises a substantially tubular nozzle body 510", which extends from a first end 512" to a second end 515". A flare portion 516" extends from the second end 515". While not illustrated, a nozzle attachment protrusion 518" (not shown), having a nozzle attachment aperture 519" may optionally be formed in or extend from at least a portion of the nozzle body 510".

An inner diameter of at least a portion of the first end 512" of the nozzle body 510" is formed so as to be attached or coupled to the second end 415 (or 715) of the heat shielding element 410 (or 710). The nozzle element 500" is attached or coupled to at least a portion of the second end 415 (or 715) of the heat shielding element 410 (or 710), as described herein with respect to the nozzle element 500.

As further illustrated, the flare portion 516" extends to form an extended flare portion that is formed so as to be attached or coupled to a collar 1420. The collar 1420 is formed so as to provide a transition between the flare portion 516" and a suppressor mount 1430. In these exemplary embodiments, the collar 1420 is able to provide a substantially airtight seal between the flare portion 516" and the suppressor mount 1430.

In various exemplary embodiments, the suppressor mount 1430 (and attached or coupled suppressor heat shielding element 1410) can be attached, coupled, or connected to the flare portion 516" by the use of a flexible material tube section, or collar 1420. If included, the collar 1420 may be formed of a heat resistant material and or silicone impregnation to retain heat and reduce signature. In this manner, a flexible flue or chimney is formed without affecting the freefloat nature of the barrel and suppressor assembly in relation to the suppressor heat shielding element 1410 and the accompanying heat shielding.

The collar 1420 may be of variable length and may be reinforced with wire spiral or mesh layer.

In certain exemplary embodiments, the flare portion 516" is formed so as to be attached or coupled to the suppressor mount 1430, without the inclusion of the collar 1420. Thus, in the suppressor related heat shielding and thermal venting system 1400, the suppressor mount 1430 is configured on the end of the rifle barrel 50 that is retained by the suppressor 58 or a related muzzle device through, for example, a threaded section or a push 'friction' fit.

The suppressor mount 1430 includes a mounting aperture 1432 that allows at least a portion of a threaded barrel extension (or other muzzle device, such as, for example, a suppressor attachment device) to pass therethrough. In this manner, a suppressor 58 may be attached, coupled, or mounted to the barrel 50. In certain alternative embodiments, the mounting aperture 1432 comprises an internally threaded mounting aperture 1432, which allows the suppressor mount 1430 to be threaded late attached to the threaded barrel extension.

In still other embodiments, the mounting aperture 1432 may be formed so as to interact with a suppressor attachment device to couple, attach, or mount the suppressor mount 1430 to the barrel 50.

The suppressor mount 1430 is formed so as to be attached or coupled to a suppressor heat shielding element 1410. The suppressor heat shielding element 1410 extends from a first end 1412 to a muzzle end or second end 1415. The second end 1415 generally forms a cap having an exit aperture 1417. The suppressor heat shielding element 1410 and the second end 1415 define an internal cavity 1418 within the suppressor heat shielding element 1410. The first end 1412 is typically open and the internal cavity 1418 is formed such that a suppressor 58 can be fully or at least partially contained within the internal cavity 1418 of the suppressor heat shielding element 1410.

A plurality of internal supports 1419 extend from the internal side walls of the suppressor heat shielding element 1410 at spaced apart locations. The internal supports 1419 extend or protrude into the internal cavity 1418. The internal supports 1419 form the support for the suppressor heat shielding element 1410 that is positioned over the suppressor 58 to form an air gap between the suppressor surface and the inside surface of the internal cavity 1418 of the suppressor heat shielding element 1410. The suppressor heat shielding element 1410 is also formed to cover the front of the suppressor 58 and protrude slightly forward the muzzle area of the suppressor 58. The suppressor heat shielding element 1410 is fixed to the suppressor mount 1430.

The suppressor heat shielding element 1410 also features internal supports 1419 with gaps that rest against the suppressor 58 at the front so that the entire assembly is secure to the suppressor 58 itself. The rear of the suppressor heat shielding element 1410 is open to allow air to be drawn in.

When an attached suppressor 58 is positioned within the internal cavity 1418 and the suppressor heat shielding element 1410 is attached or coupled to the suppressor mount 1430, the collar 1420, and the flare portion 516", the rear, sides, and a portion of the front of the suppressor 58 are contained within the heat shielding and thermal venting system 1400 (leaving open the exit aperture 1417, which is aligned with the exit aperture of the suppressor 58), the thermal signature of the attached suppressor 58 is reduced and/or eliminated.

One or more apertures 1435 are formed in the suppressor mount 1430. In this manner, the blast or exhaust gases that are created during a firing cycle are able to flow through the heat shielding element 410 (or 710), the nozzle element 500", the one or more apertures 1435, the air gap between the exterior of the suppressor 58 and the internal cavity 1418 (as provided by the internal supports 1419), and through the exit aperture 1417.

Because the suppressor heat shielding element 1410 encases most, if not all, of the suppressor 58 and the second end 1415 forms a reduced exit aperture 1417, the exit aperture 1417 constitutes a Venturi constriction or restricted portion, which can act to cause ambient air to be sucked into the one or more entry apertures 430 and/or the one or more apertures 1435 when the firearm is fired. An additional Venturi effect is created as air is drawn over the suppressor 58 and into the blast stream as the firearm is fired.

As the firearm is fired and a round exits the suppressor 58, blast or exhaust gas exits the muzzle and flows across the opening formed by the suppressor heat shielding element 1410 and protrusion area. Through the Bernoulli Effect, air is drawn from the gap and into the blast gas. This system causes cool air to be drawn into the rear of the suppressor heat shielding element 1410 from the heat shielding element 410 (or 710), across the surface of the suppressor 58 and out the exit aperture 1417, each time the gun is fired. It also allows a chimney or stack effect when raised or lowered. Additionally if the firearm is elevated a stack or chimney effect is induced causing air to move through the entire system.

Figure 61:
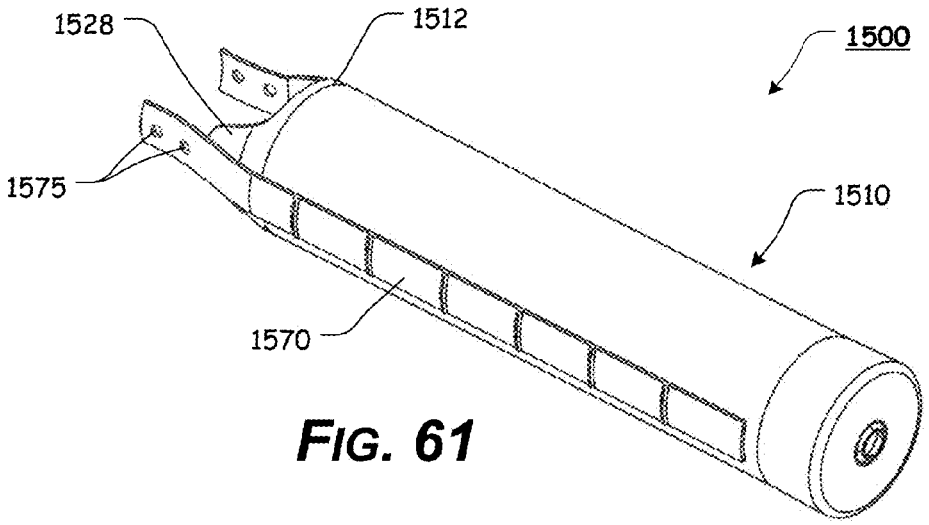
FIG. 61 illustrates a front perspective view showing certain elements of an exemplary embodiment of an outer heat shield assembly, according to the present disclosure.
Figure 62:
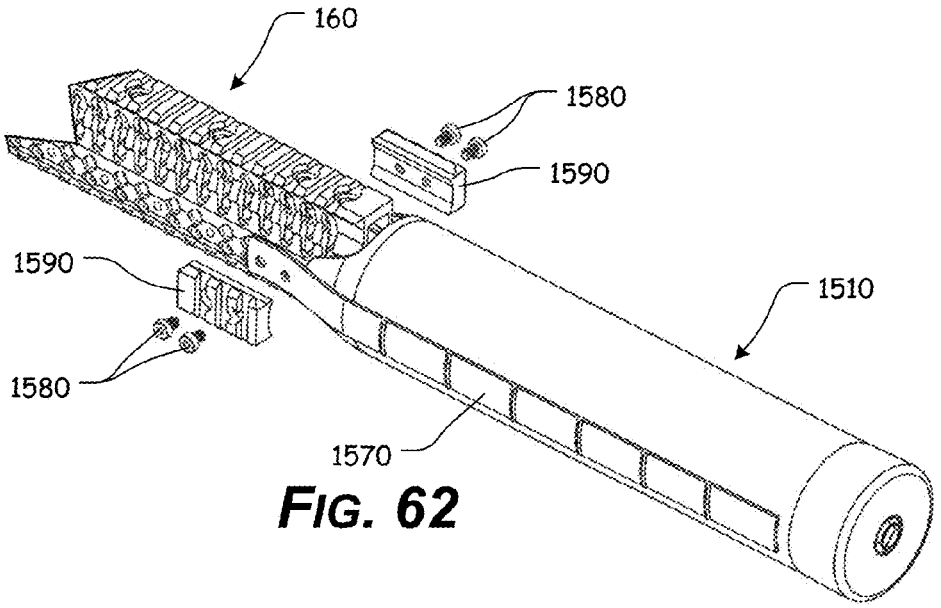
FIG. 62 illustrates a front perspective view showing certain elements of an exemplary embodiment of an outer heat shield assembly attached or coupled to an exemplary handguard, according to the present disclosure.

FIGS. 61-62 illustrate an exemplary embodiment of a heat shielding and thermal venting system 1500, according to the present disclosure. As illustrated in FIGS. 61-62, the heat shielding and thermal venting system 1500 is designed so as to operate with or without a heat shielding element 410 or heat shielding element 710. As illustrated, the heat shielding of thermal venting system 1500 includes a suppressor heat shielding element 1510. The suppressor heat shielding element 1510 includes elements similar to those of the suppressor heat shielding element 1410.

However, in certain exemplary embodiments, the suppressor heat shielding element 1510 optionally includes an extension portion 1528 that extends from the first end 1512. The extension portion 1528, if included, is formed so as to extend toward, and optionally at least partially around a portion of the handguard 160.

The suppressor heat shielding element 1510 provides a cover or 'sock' that is able to cover all or at least a portion of a suppressor.

The heat shielding and thermal venting system 1500 further comprises a strap element 1570 that is attached or coupled to an outer surface of the suppressor heat shielding element 1510 and extends rearward so that the strap element 1570 may be attached or coupled to the handguard 160. In various exemplary embodiments, the strap element 1570 is attached or coupled to the handguard 160 via interaction of bolts or screws 1590, apertures 1575 formed in the strap element 1570, and apertures formed in the handguard 160.

The strap elements 1570 may also be used to retain the suppressor heat shielding element 1510 in place relative to the handguard 160. The strap elements 1570 attach to the handguard 160, while retaining the suppressor heat shielding element 1510 in place at the front.

In certain exemplary embodiments, the strap elements 1570 provide attachment points along their respective lengths using a 'molle' or similar attachment system. Additionally, attachable rail portions 1590 may also be attached or coupled, via the bolts or screws 1590.

While the present disclosure has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A heat shielding and thermal venting system, comprising:

a heat shielding element comprising an elongate, tubular member extending from a first end to a second end and including a primary portion and a secondary portions, wherein said secondary portion has a reduced inner cross-sectional area when compared to an inner cross-sectional area of said primary portion;

a plurality of entry apertures formed through said heat shielding element proximate said first end; and one or more restricted portions formed within said secondary portion of said heat shielding element, wherein each restricted portion includes a second reduced inner cross-sectional area, when compared to an inner cross-sectional area of an adjacent interior portion of said secondary portion of said heat shielding element;

wherein said primary portion has an interior cavity portion that is sized so as to contain at least a portion of a barrel, a gas tube and a gas block; and wherein at least a portion of said heat shielding element is configured to be maintained within a handguard.

2. The heat shielding and thermal venting system of claim 1, wherein said heat shielding element comprises carbon fiber.

3. The heat shielding and thermal venting system of claim 1, wherein said primary portion and said secondary portion are in continuous, fluid communication with one another.

4. The heat shielding and thermal venting system of claim 1, wherein said secondary portion has an interior cavity portion that is sized so as to allow at least a portion of a barrel and/or a muzzle device to be at least partially contained within said interior cavity portion of said secondary portion.

5. The heat shielding and thermal venting system of claim 1, wherein a wall thickness of said heat shielding element is varied along a length of said heat shielding element.

6. The heat shielding and thermal venting system of claim 1, wherein said entry apertures comprise a plurality of holes formed through said heat shielding element.

7. The heat shielding and thermal venting system of claim 1, further comprising a nozzle element having a substantially tubular nozzle body, wherein said nozzle element extends from a first end to a second end, wherein said nozzle element comprises a flare portion extending from said second end, and wherein said first end of said nozzle body is attached or coupled to said second end of said heat shielding element.

8. The heat shielding and thermal venting system of claim 1, wherein said at least one restricted portion provides a reduced diameter section that restricts airflow within at least one defined portion of said heat shielding element.

9. The heat shielding and thermal venting system of claim 8, wherein said at least one reduced diameter section provides for a Venturi or Bernoulli Effect proximate said at least one reduced diameter section.

10. A heat shielding and thermal venting system, comprising:

a heat shielding element comprising an elongate, tubular member extending from a first end to a second end and including a primary portion and a secondary portions, wherein said secondary portion has a reduced inner cross-sectional area when compared to an inner cross-sectional area of said primary portion;

a plurality of entry apertures formed through said heat shielding element proximate said first end at least one restricted portion formed within said secondary portion of said heat shielding element, wherein said at least one restricted portion includes a reduced inner cross-sectional area, when compared to an inner cross-sectional area of an adjacent interior portion of said secondary portion of said heat shielding element; and a nozzle element comprising a substantially tubular nozzle body, wherein said nozzle element extends from a first end to a second end, wherein said nozzle element comprises a flare portion extending from said second end, and wherein said first end of said nozzle body is attached or coupled to said second end of said heat shielding element; and wherein at least a portion of said heat shielding element and at least a portion of said nozzle element is configured to be maintained within a handguard.

11. The heat shielding and thermal venting system of claim 10, wherein said first end of said nozzle body is releasably attached or coupled to said second end of said heat shielding element.

12. The heat shielding and thermal venting system of claim 10, further comprising two or more restricted portions formed along said secondary portion of said heat shielding element, wherein each restricted portion includes a reduced inner cross-sectional area, when compared to an inner cross-sectional area of an adjacent interior portion of said secondary portion of said heat shielding element.

13. The heat shielding and thermal venting system of claim 10, further comprising a nozzle attachment protrusion extending from at least a portion of said nozzle body and at least one nozzle attachment aperture formed in said nozzle attachment protrusion, wherein said nozzle element may be maintained in a position relative to said heat shielding element and/or a handguard through use of one or more mounting bolts or screws positioned through said at least one nozzle attachment aperture and aligned apertures formed in said handguard.

14. The heat shielding and thermal venting system of claim 10, wherein said primary portion, said secondary portion, and said nozzle element are in continuous, fluid communication with one another.

* * * * *